US009664023B1

(12) United States Patent
Griffin

(10) Patent No.: US 9,664,023 B1
(45) **Date of Patent: *May 30, 2017**

(54) METHODS FOR RECOVERING LIGHT HYDROCARBONS FROM SHALE USING THERMALLY-INDUCED MICROFRACTURES

(71) Applicant: Don P. Griffin, Katy, TX (US)

(72) Inventor: Don P. Griffin, Katy, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/388,822

(22) Filed: Dec. 22, 2016

Related U.S. Application Data

(63) Continuation-in-part of application No. 14/850,029, filed on Sep. 10, 2015, now Pat. No. 9,556,719.

(51) Int. Cl.

| | |
|---|---|
| ***E21B 43/267*** | (2006.01) |
| ***E21B 43/247*** | (2006.01) |
| ***E21B 33/12*** | (2006.01) |
| ***E21B 43/26*** | (2006.01) |

(52) U.S. Cl.
CPC ..... *E21B 43/247* (2013.01); *E21B 33/12* (2013.01); *E21B 43/26* (2013.01)

(58) Field of Classification Search
None
See application file for complete search history.

(56) References Cited

U.S. PATENT DOCUMENTS

| | | | | |
|---|---|---|---|---|
| 7,882,893 | B2 * | 2/2011 | Fraim | E21B 43/243 166/260 |
| 8,672,027 | B2 * | 3/2014 | Billman | E21B 43/24 166/259 |
| 9,556,719 | B1 * | 1/2017 | Griffin | E21B 43/247 |
| 2008/0087427 | A1 * | 4/2008 | Kaminsky | E21B 41/0064 166/272.1 |

* cited by examiner

*Primary Examiner* — Angela M DiTrani
*Assistant Examiner* — Andrew H Sue-Ako
(74) *Attorney, Agent, or Firm* — The Elliott Law Firm, PLLC; Douglas H. Elliott

(57) ABSTRACT

One or more specific embodiments herein includes a method for hydraulically re-fracturing a shale formation comprising injecting oxidizer through a horizontal wellbore into a fracture in the shale formation comprising pores containing hydrocarbon gas or liquid, and recovering some of the hydrocarbon gas or liquid from the shale formation. Some of the injected oxidizer combusts and increases the temperature of a portion of the shale formation and of the hydrocarbon gas or liquid contained in some of the pores in the shale formation, at least some of the hydrocarbon liquid is heated and turns to hydrocarbon gas, the pressure of some of the hydrocarbon gas increases to a point sufficient to cause formation of new fractures, and some of the hydrocarbon gas passes from the pores through some of the new fractures and can be thereafter recovered. Preferably, one or more specific embodiments further comprises injecting hydraulic fracturing fluid into the first fracture after the one or more second fractures is formed, sometimes referred to as re-fracing.

11 Claims, 12 Drawing Sheets

METHODS FOR RECOVERING LIGHT HYDROCARBONS FROM SHALE USING THERMALLY-INDUCED MICROFRACTURES

RELATED APPLICATIONS

This application is a continuation-in-part of and claims benefit to non-provisional application Ser. No. 14/850,029, filed on Sep. 10, 2015, and hereby incorporates that application and all amendments thereto as if set forth in their entireties.

BACKGROUND

Field of Inventions

The field of this application and any resulting patent is recovery of hydrocarbons from shale.

Description of Related Art

Various methods and devices have been proposed and utilized to recover hydrocarbons, including the methods and devices disclosed in the references appearing on the face of this patent and of the earlier-issued patent upon which this patent claims priority. However, these methods and devices lack all the steps or features of the methods covered by the patent claims below. Furthermore, the methods covered by at least some of the claims of this issued patent solve many of the problems that prior art methods have failed to solve. Also, the methods covered by at least some of the claims of this patent have benefits that would be surprising and unexpected to a person of ordinary skill in the art based on the prior art existing at the time of invention.

SUMMARY

Disclosed herein are one or more methods for hydraulically re-fracturing a shale formation section which, prior to being heated from combustion of oxidizer, comprises hydrocarbons with substantially no kerogen or heavy oils having an API gravity of less than 25 degrees, which methods may include: (a) injecting oxidizer through a horizontal wellbore and into the shale formation section, wherein the shale formation section includes a shale matrix having a structure with substantially no kerogen or heavy oils with an API gravity of less than 25 degrees, a primary fracture formed by a previous hydraulic fracturing operation, residual hydrocarbons in the primary fracture, and pores that contain hydrocarbons and substantially no kerogen or heavy oils having an API gravity of less than 25 degrees; (b) reacting at least a portion of the oxidizer with residual hydrocarbons in the primary fracture to form a combustion product and heat, wherein the residual hydrocarbons are hydrocarbons remaining in the primary fracture after a previous hydraulic fracturing operation; (c) transferring the heat through the shale matrix to a first and a second pore that each contain hydrocarbon gas or liquid; (d) rupturing the first pore by heating hydrocarbon gas or liquid contained in the first pore and thereby raising the temperature of any hydrocarbon gas and of any hydrocarbon liquid in the first pore sufficiently for the hydrocarbon liquid to form hydrocarbon gas and raising the pressure of hydrocarbon gas being heated in the first pore to a level sufficient to rupture the first pore, weaken the structure of the shale matrix, and form a first micro-fracture in the shale matrix, wherein the first micro-fracture is connected to the primary fracture and contains hydrocarbon gas or liquid that is consumed by combustion; (e) rupturing the second pore by heating hydrocarbon gas or liquid contained in the second pore and thereby raising the temperature of any hydrocarbon liquid in the second pore sufficiently for the hydrocarbon liquid to form hydrocarbon gas and raising the pressure of the hydrocarbon gas being heated in the second pore to a level sufficient to rupture the second pore, weaken the structure of the shale matrix, and form a second micro-fracture in the shale matrix, wherein the second micro-fracture is not connected to the primary fracture and contains hydrocarbon gas or liquid that is not consumed by combustion, wherein the first pore and the second pore are each located within five feet of the primary fracture and the temperature of the shale matrix surrounding the first and second pores experiences an increase of 100 to 300 degrees Fahrenheit within a period of 1 to 7 days from when the combustion product is formed in the primary fracture as a result of the reaction of the oxidizer with the residual hydrocarbons; and (f) injecting hydraulic fracturing fluid through the horizontal wellbore and into the primary fracture to form one or more macro-fractures in the shale matrix having a weakened structure by expanding or coalescing the first and second micro-fractures during the injecting of the hydraulic fracturing fluid.

Also disclosed herein are one or more methods for hydraulically re-fracturing a shale formation section which, prior to being heated from combustion of oxidizer, comprises hydrocarbons with substantially no kerogen or heavy oils having an API gravity of less than 25 degrees, wherein the wellbore has a first wellbore section and a second wellbore section, which methods may include: (a) positioning one or more packers in the wellbore such that the first wellbore section is substantially isolated from fluid communication with the second wellbore section, a first primary fracture formed by a previous hydraulic fracturing operation is connected to the first wellbore section and contains residual hydrocarbons, and a second primary fracture formed by a previous hydraulic fracturing operation is connected to the second wellbore section and contains residual hydrocarbons, wherein the first and second primary fractures are in a shale formation section that includes a shale matrix that includes pores containing hydrocarbon gas or liquid and having a structure with substantially no kerogen or heavy oils with an API gravity of less than 25 degrees; (b) injecting oxidizer into the first wellbore section; (c) reacting oxidizer with residual hydrocarbons in the first primary fracture to form a combustion product and heat, wherein the residual hydrocarbons are hydrocarbons remaining in the first primary fracture after a previous hydraulic fracturing operation; (d) transferring the heat through the shale matrix to a first primary fracture pore that contains hydrocarbon gas or liquid; (e) rupturing the first primary fracture pore by heating hydrocarbon gas or liquid contained in the first primary fracture pore and thereby raising the temperature of any hydrocarbon gas in the first primary fracture pore and of any hydrocarbon liquid in the first primary fracture pore sufficiently for the hydrocarbon liquid to form hydrocarbon gas and raising the pressure of hydrocarbon gas being heated in the first primary fracture pore to a level sufficient to rupture the first primary fracture pore, weaken the structure of the shale matrix, and form a first micro-fracture in the shale matrix, which first micro-fracture is either connected to the first primary fracture and contains hydrocarbons that are consumed by combustion or is not connected to the first primary fracture and contains hydrocarbons that are not consumed by combustion, wherein the first primary fracture pore is located within five feet of the first primary fracture and the temperature of the shale matrix surrounding the first primary fracture pore experiences an increase of 100 to 300 degrees Fahrenheit within a period of 1 to 7 days from when the combustion product is formed in the first primary fracture as a result of the reaction of the oxidizer with the residual hydrocarbons; (f) injecting hydraulic fracturing fluid through the horizontal wellbore and into the first primary fracture to form one or more macro-fractures in the shale matrix having a weakened structure by expanding or coalescing the micro-fractures during the injecting of the hydraulic fracturing fluid; (g) injecting oxidizer into the second wellbore section; (h) reacting oxidizer with residual hydrocarbons in the second primary fracture to form a combustion product and heat, wherein the residual hydrocarbons are hydrocarbons remaining in the second primary fracture after a previous hydraulic fracturing operation; (k) transferring the heat through the shale matrix to a second primary fracture pore that contains hydrocarbon gas or liquid; (l) rupturing the second primary fracture pore by heating hydrocarbon gas or liquid contained in the second primary fracture pore and thereby raising the temperature of any hydrocarbon gas in the second primary fracture pore and of any hydrocarbon liquid in the second primary fracture pore sufficiently for the hydrocarbon liquid to form hydrocarbon gas and raising the pressure of the hydrocarbon gas being heated in the second primary fracture pore to a level sufficient to rupture the second primary fracture pore, weaken the structure of the shale matrix, and form a second micro-fracture in the shale matrix, wherein the second micro-fracture is either connected to the second primary fracture and contains hydrocarbons that are consumed by combustion or is not connected to the second primary fracture and contains hydrocarbons that are not consumed by combustion, wherein the second primary fracture pore is located within five feet of the first primary fracture and the temperature of the shale matrix surrounding the second primary fracture pore experiences an increase of 100 to 300 degrees Fahrenheit within a period of 1 to 7 days from when the combustion product is formed in the first primary fracture as a result of the reaction of the oxidizer with the residual hydrocarbon gas; and (m) injecting hydraulic fracturing fluid through the wellbore and into the second primary fracture to form one or more macro-fractures in the shale matrix which has a weakened structure by expanding or coalescing the micro-fractures during the injecting of the hydraulic fracturing fluid, wherein hydraulic fracturing fluid is injected through the wellbore and into the first primary fracture either before or after the oxidizer is injected into the second wellbore section and hydraulic fracturing fluid is injected through the wellbore.

One or more specific embodiments herein includes a method for recovering hydrocarbon gas from a shale formation, comprising injecting oxidizer through a horizontal wellbore into a first fracture in the shale formation, which shale formation includes confined pores containing hydrocarbon gas, and which shale formation includes a shale matrix surrounding the confined pores, injecting hydraulic fracturing fluid comprising proppants through the horizontal wellbore into the shale formation, and recovering at least a portion of the hydrocarbon gas, wherein portions of the oxidizer react with residual hydrocarbons to form a combustion product and heat, the heat from the combustion is transferred through the shale matrix to at least some of the confined pores containing hydrocarbon gas, hydrocarbon gas contained in at least some of the confined pores is heated to form heated hydrocarbon gas, and the temperature and pressure of the heated hydrocarbon gas is raised, the pressure of the heated hydrocarbon gas is raised to a level sufficient to cause a second fracture to form in the shale matrix, which second fracture is connected to at least one of the confined pores containing the heated hydrocarbon gas, at least some of the hydraulic fracturing fluid enters the second fracture, and at least some hydrocarbon gas passes from at least some of the confined pores through at least a portion of the second fracture and exits the shale formation.

One or more specific embodiments herein includes a method for recovering hydrocarbon gas from a shale formation comprising injecting oxidizer through a horizontal wellbore into a fracture in the shale formation comprising pores containing hydrocarbon gas, and recovering at least some of the hydrocarbon gas from the shale formation, wherein some of the injected oxidizer combusts and increases the temperature of a portion of the shale formation and of the hydrocarbon gas contained in at least some of the pores in the shale formation, the pressure of at least some of the hydrocarbon gas increases to a point sufficient to cause formation of new fractures, and at least some of the hydrocarbon gas passes from the pores through some of the new fractures and is recovered.

One or more specific embodiments herein includes a method for recovering hydrocarbons from a shale formation, comprising injecting oxidizer through a horizontal wellbore into a first fracture in the shale formation, which shale formation includes a shale matrix and confined pores that comprise a first group of confined pores and a second group of confined pores, wherein the first and second groups of confined pores each contains hydrocarbons, and wherein residual hydrocarbons are in the horizontal wellbore or the first fracture, or both, forming one or more second fractures, and recovering at least a portion of the hydrocarbons from the confined pores through at least one second fracture, wherein at least a portion of the oxidizer mixes with residual hydrocarbons and reacts to form a combustion product and to generate heat, at least some of the heat is transferred through the shale matrix to at least some of the first and second groups of confined pores, the temperature and pressure of at least some of the hydrocarbons contained in the first group of confined pores are raised, the pressure of at least some of the hydrocarbons contained in the first group of confined pores is raised to a level sufficient to cause formation of one or more of the second fractures, at least one of the second fractures is connected to at least one of the first group of confined pores containing hydrocarbons, at least some of the hydrocarbons in at least some of the first group of confined pores is combusted, and at least some of the hydrocarbon passes from one or more of the second group of confined pores through at least one of the second fractures and is recovered.

One or more specific embodiments herein includes a method for recovering hydrocarbon gas from a shale formation comprising injecting oxidizer through a horizontal wellbore and into a fracture present within the shale formation, which shale formation comprises a shale matrix having confined pores containing hydrocarbon gas, and recovering at least a portion of the hydrocarbon gas, wherein hydrocarbons are present in the fracture, the hydrocarbons combust in a combustion zone within the fracture to form a combustion product having a temperature of 800 Fahrenheit or more, at least a portion of the shale matrix proximate the combustion zone is heated, heat is transferred through the shale matrix to at least some of the confined pores containing hydrocarbon gas, the pressure of the hydrocarbon gas contained in the confined pores increases to a pressure sufficient to increase the permeability of the shale formation, and the hydrocarbon gas moves through at least a portion of the shale matrix and exits the shale formation.

One or more specific embodiments herein includes a method for recovering hydrocarbon gas from a shale formation comprising injecting steam having an incremental temperature of at least 100 degrees Fahrenheit higher than the initial reservoir temperature into a first fracture in the shale formation, which shale formation comprises confined pores containing hydrocarbon gas, and recovering at least a portion of the hydrocarbon gas, wherein the steam has an incremental temperature of at least 100 degrees Fahrenheit higher than the initial reservoir temperature when entering the first fracture, at least some of the heat of the steam is transferred to at least some of the confined pores in shale formation, and the heat transferred to the confined pores causes the pressure of the hydrocarbon gas within the confined pores to increase to a pressure sufficient to cause the formation of one or more second fractures connected to at least one of the confined pores.

One or more specific embodiments herein includes a method for recovering hydrocarbon gas from a shale formation comprising inserting at least one packer comprising an annular structure into a wellbore, resulting in the formation of a first wellbore section that is separated by the packer from a second wellbore section, injecting an oxidizer through the wellbore into a first fracture connected to the first wellbore section in the shale formation, which shale formation comprises a shale matrix surrounding confined pores containing hydrocarbon gas, injecting hydraulic fracturing fluid comprising proppants through the first wellbore section into the shale formation, and recovering at least a portion of the hydrocarbon gas, wherein portions of the oxidizer react with residual hydrocarbon gas to form heat, the heat is transferred through the shale matrix to at least some of the confined pores containing hydrocarbon gas, the pressure and temperature of the hydrocarbon gas is raised to a level sufficient to cause a second fracture to form in the shale formation, which second fracture is connected to at least one of the heated confined pores containing hydrocarbon gas, at least some of the hydraulic fracturing fluid enters the second fracture, and at least some of the hydrocarbon gas passes from at least some of the confined pores through at least a portion of the second fracture and exits the shale formation.

DETAILED DESCRIPTION

1. Introduction

Figure 1:
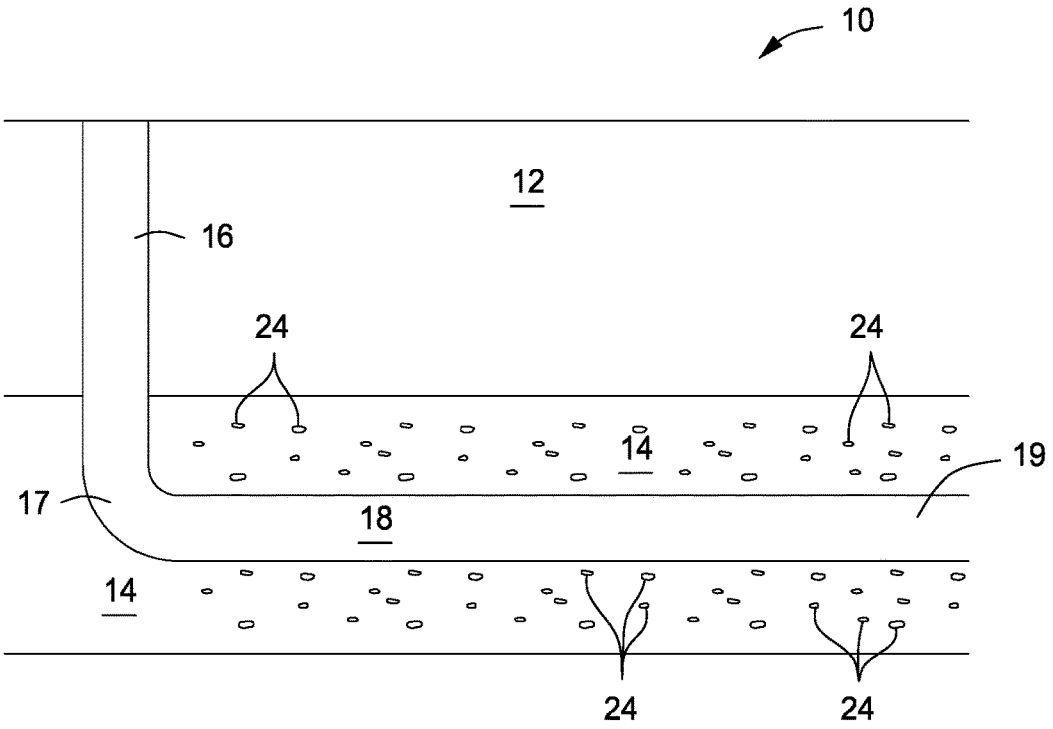
FIG. 1 is a simplified depiction of a horizontal wellbore situated within a shale formation.

A detailed description will now be provided. The purpose of this detailed description, which includes the drawings, is to satisfy the statutory requirements of 35 U.S.C. §112. For example, the detailed description includes a description of the inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details of the systems, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments of the inventions (e.g., versions and/or examples), but the inventions are not limited to these specific embodiments, which are included to enable a person having ordinary skill in the art to make and use the inventions when the information in this patent is combined with available information and technology.

Various terms as used herein are defined below, and the definitions should be adopted when construing the claims that include those terms, except to the extent a different definition is given elsewhere within the specification or in express representations to the Patent and Trademark Office (PTO). To the extent a term used in a claim is not defined in this detailed description or in any representation to the PTO, that term should be given the broadest definition persons having skill in the art have given that term as reflected in at least one printed publication, dictionary, published patent application, or issued patent.

2. Selected Definitions

Certain claims include one or more of the following terms which, as used herein, are expressly defined below.

The term "shale formation" as used herein is defined as any formation within the earth's crust that is primarily composed of shale, although a shale formation may include other types of rock. The term "shale" as used herein is defined according to its plain meaning as the term is used by persons skilled in the art, preferably being a sedimentary rock having a fissile or laminated structure formed by the consolidation of clay or argillaceous material. (Dictionary.reference.com.) A shale formation may have low permeability and even be substantially impermeable (i.e., permeability less than 1 microdarcy). More broadly, a shale formation may include shale having a permeability ranging from, for example, 0.01, 0.05, 0.1, 1, 5, 10, 50, or 100 nanodarcys up to 0.1, 0.5, 1, 2, or 5 microdarcys. Despite having low permeability, a shale formation may be porous, with an average porosity ranging from near zero percent to a high of 12% to 15%. Preferably, the shale formation and the shale matrix have poor conductivity ranging from 1 to 4 Watts per meter-Kelvin, considered by some to be an insulator. A shale formation may be positioned underneath another rock formation. A shale formation may comprise a shale matrix and confined pores containing hydrocarbons. Confined pores in a shale formation may be substantially isolated from one another. A shale formation may vary greatly in depth, and the properties of the hydrocarbons of the shale formation may depend at least partially on the depth of the shale formation. A shale formation may be capable of fracturing along its lamina. A shale formation may primarily comprise shale, but may also comprise other types of rock. For example, a shale formation may comprise a shale matrix positioned within a formation made of other types of rock. Examples of shale formations include the Eagle Ford shale formation in Texas and Utica shale formation in the northeast United States.

The term "shale matrix" as used herein (or simply "matrix" in certain usages) is defined herein as some part of any shale formation that is predominantly shale with only minor portions of other types of rock, such as limestone. A shale matrix is a fine-grained portion of a shale formation in which confined pores are embedded and which may also include embedded coarse crystals and/or rock fragments. A shale formation may comprise a shale matrix that is substantially impermeable (i.e., permeability less than 1 microdarcy). A shale matrix is capable of conducting heat, preferably capable of conducting sufficient heat over sufficient distance within the shale matrix to result in rupturing of confined pores and recovery of hydrocarbon gas from within those confined pores. For example, the heat conductivity of the shale matrix is preferably such that an increase in the temperature of a portion of a shale matrix in one location, e.g., proximate to a wellbore or a pre-existing fracture, will eventually result in an increase in the temperature of the shale matrix at another location, e.g., proximate to confined pores. Preferably, as discussed elsewhere herein, the conductivity of the shale matrix is sufficient to result in an increase in temperature of hydrocarbon gas within confined pores that are more than an insignificant distance, e.g., more than an inch, from the fractures that are referred to herein as "first fractures," e.g., "primary factures," e.g., pre-existing fractures formed via hydraulic fracturing before any injection of oxidizer or steam. It is contemplated that such a distance through which heat is conducted through the shale matrix can be 5 feet or more, e.g., 10 feet, or 15 feet, or more, and that heat may be transferred over such distances in one week or less. An unstimulated section of a shale formation may comprise many confined pores that are not connected to one another. A stimulated section of a shale formation, e.g., a section that has previously undergone one or more instances of hydraulic fracturing, may comprise pores that were previously confined prior to stimulation but became unconfined (in fluid communication with at least one other pore and/or fracture) by the formation of fractures in the shale formation during stimulation.

The term "confined pore" as used herein is defined as a pore in the shale formation that is "confined." Preferably, a pore is "confined" when any gas or liquid inside the pore is trapped and the pore is not connected to any other pore, fracture, or wellbore. For example, any liquid or gas within a confined pore should not leave the pore at the inherent pressure of the pore, e.g., "initial formation pressure," e.g., before any addition of heat as described herein. A confined pore is thus preferably a portion of a shale formation that is capable of containing hydrocarbon gas or liquid, occupies a space with a substantially fixed volume, and is devoid of minerals. A confined pore at certain depths may be capable of maintaining its integrity, remaining confined, when the interior pressure of the confined pore is at equilibrium with the pressure of the surrounding matrix. However, a confined pore at certain depths may lose its structural integrity when the interior pressure of the confine pore exceeds the pressure of the surrounding matrix by an amount sufficient to rupture the pore. The interior pressure of a confined pore may be dependent on the type of fluid (gas or liquid) within the confined pore as well as the temperature of that fluid. A confined pore in a shale formation may contain a hydrocarbon fluid (e.g., gas and/or liquid). A confined pore may in some cases increase in volume after rupturing, wherein the confined pore may form part of a fracture along the lamina of a surrounding shale matrix. Recovery of hydrocarbon fluid from a confined pore may in some cases be effected when the confined pore ruptures and fluid communication is established with a primary fracture or wellbore, at which time the pore ceases to be "confined."

The term "combustion product" as used herein is defined as anything produced from a combustion reaction between an oxidizer and hydrocarbon molecules. Combustion products may include water, carbon dioxide, carbon monoxide, and other common products of combustion. Combustion products may in some cases form when residual hydrocarbons and/or portions of a shale formation, e.g., the portion of the shale which forms the interior of a wellbore or fracture, ignite. Combustion products may in some cases be capable of stifling a combustion reaction by preventing the addition of oxidizer introduced without sufficient pressure to displace the combustion products. Combustion products may be removed from a wellbore by the addition of another wellbore that is in fluid communication with the wellbore in which the combustion reaction takes place. Combustion products may be removed from a wellbore by the reversal of air flow such that the injection wellbore becomes a wellbore capable of removing combustion products and/or hydrocarbons at a surface facility. Combustion may then be continued by resuming injection of oxidizer by an air pump.

The term "heating zone" as used herein is defined as any part of a wellbore or fracture having a temperature greater than the initial reservoir temperature. One example of a heating zone is a zone whose temperature is increased due to addition of heat by artificial means, e.g., combustion or injection of steam. One specific type of "heating zone" is a "combustion zone," defined as any part of a wellbore or fracture in which a combustion reaction between hydrocarbons and oxidizer occurs, forming heat. A heating zone may be any part of a wellbore or fracture into which steam is injected. Steam injected into a heating zone is preferably superheated, e.g., at a temperature ranging from a low of 500, 600, 700, 800 or 900 degrees Fahrenheit to a high of 700, 800, 900, 1000, 1100, or 1200 degrees Fahrenheit. A heating zone (e.g., a combustion zone) may be formed, for example, when combustion takes place within a horizontal wellbore, in which case the heating zone extends from the point of initial ignition or entry of steam within a wellbore through the wellbore and ends near the "toe" (end) of the wellbore. Preferably, the point of initial ignition or entry of steam is predetermined by blocking off a part of the wellbore with a packing assembly, also referred to as a packer. Multiple heating zones may be created in a wellbore and fractures in stages. For example, individual sections of a wellbore that are separated by packing assemblies may be heated and re-fractured one by one, similar to a staged hydraulic fracturing system. An illustrative example of a staged fracturing method may be found in U.S. Patent Application Publication No. 2015/0144347 which is hereby incorporated by reference as if set forth in its entirety, especially the parts of that publication describing the process of staged fracturing using packing assemblies. A heating zone may comprise a portion of a wellbore and/or one or more primary fractures in which residual hydrocarbons and/or added fuel react with an oxidizer. A heating zone may be heated from the combustion reaction or the injection of superheated steam, and the heat in the heating zone may be capable of heating sections of the shale formation (e.g., portions of the shale matrix) through conduction of heat up to 5 feet or even more from the heating zone. The heat from the heating zone may be capable of directly or indirectly heating the shale formation. For example, the heat generated from combustion in the heating zone may transfer through any components of the wellbore, e.g. casing or cement, to the shale formation.

The term "microfracture" as used herein is defined as any fracture formed as a result of a rupture of a confined pore, e.g., along the lamina of a shale formation. A microfracture is typically very small, e.g., less than 10 mm in length and less than 0.5 mm in width. Microfractures may be formed when the pressure of hydrocarbon gas within a confined pore increases to a pressure sufficient to rupture the surrounding shale matrix. The microfractures described herein, created artificially, are distinct from the small fractures that have been formed naturally over geologic time through natural processes, which may also sometimes be referred to as "microfractures." For example, it is contemplated that as kerogen located in a confined pore was buried, it was exposed to increasing heat and pressure and transformed into oil and then into gas over geologic time. Higher pressures resulting from the increased heat of a shale formation would rupture the confined pores, forming "natural" microfractures which provided a pathway for the expulsion of trapped hydrocarbons from the shale formation. Expelled hydrocarbons eventually migrated and formed conventional reservoirs found in sandstones and limestones. These ancient, natural microfractures were without proppants, however, and were closed as reservoir conditions returned to equilibrium. Microfractures formed artificially, as described herein, may serve as structural weaknesses within the shale formation which may be exploited by subsequent hydraulic fracturing. Microfractures may have a high aspect-ratio as they tend to extend in directions parallel to the lamina of the shale formation. Microfractures may be extended in length and/or width to form macrofractures. Hydrocarbon gas may be capable of exiting a confined pore by way of the microfractures and macrofractures which establish fluid communication between the confined pore and a primary fracture.

The term "connected to" as used herein is defined as being in fluid communication with. For example, a first wellbore may be connected to a second wellbore if fluids are capable of passing from the first wellbore to the second wellbore. A fracture connected to a confined pore may permit any hydrocarbons in the confined pore to pass through the fracture. A fracture connected to a confined pore may comprise proppants such as sand or manufactured proppants to maintain the gap formed by the fracture. Two portions of a shale formation may not be connected if hydrocarbons present in one portion of a shale formation cannot travel to a second portion in the shale formation due to the substantial impermeability of the shale formation. Two wellbores may be connected to one another if gases can pass from one wellbore to another wellbore.

The term "macrofracture" as used herein is defined as a fracture formed through the extension or coalescence of one or more microfractures. A macrofracture may be formed by the addition of pressure from hydraulic fracturing to a microfracture originating at a primary fracture, thereby extending the microfracture further into a shale formation. A macrofracture may be formed by the coalescence of two or more microfractures formed from two or more ruptured pores containing hydrocarbons. A macrofracture may be intentionally formed through the addition of pressure from a second hydraulic fracturing (re-fracturing) following a combustion reaction in a primary fracture.

The term "wellbore" as used herein is defined as the longitudinal opening extending through the formation, e.g., from the surface to the end of the wellbore, and, depending on the context, the term may also refer to that opening plus any downhole components, e.g. casing, cement, or tubing. The terms "horizontal wellbore" and "horizontal well" refer to a wellbore or well that has been drilled using directional drilling techniques extending through at least a part of the formation, e.g., from the surface to the "toe" (end) of the wellbore. The wellbore shown in the figures is depicted as being perfectly horizontal, but the term "horizontal" in this patent disclosure is defined to mean any orientation more than 45 degrees from vertical. At least a portion of a "horizontal" wellbore or well will be vertical, e.g., the upper portion closest to the surface, but the lower portion tends to be less vertical and closer to perfectly horizontal. For example, a horizontal wellbore may have been a kick-out wellbore from a vertical wellbore, forming one combined horizontal wellbore with a vertical portion. The transition from vertical to horizontal is referred to as the "heel" of the wellbore. In any discussion of wellbores herein, there is no particular restriction in length unless stated specifically otherwise. A wellbore can be used for injection purposes, e.g., steam or air can be injected into the shale formation via the wellbore. A wellbore can be used to remove fluids from the shale formation, e.g., for venting purposes as an opening through which combustion products may exit the wellbore, as a production well for hydrocarbons, or as a combination of venting with commingled hydrocarbon production (hereinafter referred to as a "vent wellbore").

3. Certain Specific Embodiments

Now, certain specific embodiments are described, which are by no means an exclusive description of the inventions. Other specific embodiments, including those referenced in the drawings, are encompassed by this application, and any patent that issues therefrom.

Disclosed herein are one or more methods for hydraulically re-fracturing a shale formation section which, prior to being heated from combustion of oxidizer, comprises hydrocarbons with substantially no kerogen or heavy oils having an API gravity of less than 25 degrees, which methods may include: (a) injecting oxidizer through a horizontal wellbore and into the shale formation section, wherein the shale formation section includes a shale matrix having a structure with substantially no kerogen or heavy oils with an API gravity of less than 25 degrees, a primary fracture formed by a previous hydraulic fracturing operation, residual hydrocarbons in the primary fracture, and pores that contain hydrocarbons and substantially no kerogen or heavy oils having an API gravity of less than 25 degrees; (b) reacting at least a portion of the oxidizer with residual hydrocarbons in the primary fracture to form a combustion product and heat, wherein the residual hydrocarbons are hydrocarbons remaining in the primary fracture after a previous hydraulic fracturing operation; (c) transferring the heat through the shale matrix to a first and a second pore that each contain hydrocarbon gas or liquid; (d) rupturing the first pore by heating hydrocarbon gas or liquid contained in the first pore and thereby raising the temperature of any hydrocarbon gas and of any hydrocarbon liquid in the first pore sufficiently for the hydrocarbon liquid to form hydrocarbon gas and raising the pressure of hydrocarbon gas being heated in the first pore to a level sufficient to rupture the first pore, weaken the structure of the shale matrix, and form a first micro-fracture in the shale matrix, wherein the first micro-fracture is connected to the primary fracture and contains hydrocarbon gas or liquid that is consumed by combustion; (e) rupturing the second pore by heating hydrocarbon gas or liquid contained in the second pore and thereby raising the temperature of any hydrocarbon liquid in the second pore sufficiently for the hydrocarbon liquid to form hydrocarbon gas and raising the pressure of the hydrocarbon gas being heated in the second pore to a level sufficient to rupture the second pore, weaken the structure of the shale matrix, and form a second micro-fracture in the shale matrix, wherein the second micro-fracture is not connected to the primary fracture and contains hydrocarbon gas or liquid that is not consumed by combustion, wherein the first pore and the second pore are each located within five feet of the primary fracture and the temperature of the shale matrix surrounding the first and second pores experiences an increase of 100 to 300 degrees Fahrenheit within a period of 1 to 7 days from when the combustion product is formed in the primary fracture as a result of the reaction of the oxidizer with the residual hydrocarbons; and (f) injecting hydraulic fracturing fluid through the horizontal wellbore and into the primary fracture to form one or more macro-fractures in the shale matrix having a weakened structure by expanding or coalescing the first and second micro-fractures during the injecting of the hydraulic fracturing fluid.

Also disclosed herein are one or more methods for hydraulically re-fracturing a shale formation section which, prior to being heated from combustion of oxidizer, comprises hydrocarbons with substantially no kerogen or heavy oils having an API gravity of less than 25 degrees, wherein the wellbore has a first wellbore section and a second wellbore section, which methods may include: (a) positioning one or more packers in the wellbore such that the first wellbore section is substantially isolated from fluid communication with the second wellbore section, a first primary fracture formed by a previous hydraulic fracturing operation is connected to the first wellbore section and contains residual hydrocarbons, and a second primary fracture formed by a previous hydraulic fracturing operation is connected to the second wellbore section and contains residual hydrocarbons, wherein the first and second primary fractures are in a shale formation section that includes a shale matrix that includes pores containing hydrocarbon gas or liquid and having a structure with substantially no kerogen or heavy oils with an API gravity of less than 25 degrees; (b) injecting oxidizer into the first wellbore section; (c) reacting oxidizer with residual hydrocarbons in the first primary fracture to form a combustion product and heat, wherein the residual hydrocarbons are hydrocarbons remaining in the first primary fracture after a previous hydraulic fracturing operation; (d) transferring the heat through the shale matrix to a first primary fracture pore that contains hydrocarbon gas or liquid; (e) rupturing the first primary fracture pore by heating hydrocarbon gas or liquid contained in the first primary fracture pore and thereby raising the temperature of any hydrocarbon gas in the first primary fracture pore and of any hydrocarbon liquid in the first primary fracture pore sufficiently for the hydrocarbon liquid to form hydrocarbon gas and raising the pressure of hydrocarbon gas being heated in the first primary fracture pore to a level sufficient to rupture the first primary fracture pore, weaken the structure of the shale matrix, and form a first micro-fracture in the shale matrix, which first micro-fracture is either connected to the first primary fracture and contains hydrocarbons that are consumed by combustion or is not connected to the first primary fracture and contains hydrocarbons that are not consumed by combustion, wherein the first primary fracture pore is located within five feet of the first primary fracture and the temperature of the shale matrix surrounding the first primary fracture pore experiences an increase of 100 to 300 degrees Fahrenheit within a period of 1 to 7 days from when the combustion product is formed in the first primary fracture as a result of the reaction of the oxidizer with the residual hydrocarbons; (f) injecting hydraulic fracturing fluid through the horizontal wellbore and into the first primary fracture to form one or more macro-fractures in the shale matrix having a weakened structure by expanding or coalescing the micro-fractures during the injecting of the hydraulic fracturing fluid; (g) injecting oxidizer into the second wellbore section; (h) reacting oxidizer with residual hydrocarbons in the second primary fracture to form a combustion product and heat, wherein the residual hydrocarbons are hydrocarbons remaining in the second primary fracture after a previous hydraulic fracturing operation; (k) transferring the heat through the shale matrix to a second primary fracture pore that contains hydrocarbon gas or liquid; (l) rupturing the second primary fracture pore by heating hydrocarbon gas or liquid contained in the second primary fracture pore and thereby raising the temperature of any hydrocarbon gas in the second primary fracture pore and of any hydrocarbon liquid in the second primary fracture pore sufficiently for the hydrocarbon liquid to form hydrocarbon gas and raising the pressure of the hydrocarbon gas being heated in the second primary fracture pore to a level sufficient to rupture the second primary fracture pore, weaken the structure of the shale matrix, and form a second micro-fracture in the shale matrix, wherein the second micro-fracture is either connected to the second primary fracture and contains hydrocarbons that are consumed by combustion or is not connected to the second primary fracture and contains hydrocarbons that are not consumed by combustion, wherein the second primary fracture pore is located within five feet of the first primary fracture and the temperature of the shale matrix surrounding the second primary fracture pore experiences an increase of 100 to 300 degrees Fahrenheit within a period of 1 to 7 days from when the combustion product is formed in the first primary fracture as a result of the reaction of the oxidizer with the residual hydrocarbon gas; and (m) injecting hydraulic fracturing fluid through the wellbore and into the second primary fracture to form one or more macro-fractures in the shale matrix which has a weakened structure by expanding or coalescing the micro-fractures during the injecting of the hydraulic fracturing fluid, wherein hydraulic fracturing fluid is injected through the wellbore and into the first primary fracture either before or after the oxidizer is injected into the second wellbore section and hydraulic fracturing fluid is injected through the wellbore.

One or more specific embodiments disclosed herein include a method for hydraulically re-fracturing a shale formation section which, prior to being heated from steam, comprises hydrocarbons with substantially no kerogen or heavy oils having an API gravity of less than 25 degrees, including: (a) injecting steam through a wellbore and into the shale formation section, wherein the shale formation section includes a shale matrix having a structure with substantially no kerogen or heavy oils with an API gravity of less than 25 degrees, a primary fracture formed by a previous hydraulic fracturing operation, and pores that contain hydrocarbon gas or liquid; (b) adding heat to the primary fracture via the injected steam; (c) transferring the heat from the injected steam through the shale matrix to a pore that contains hydrocarbon gas or liquid; (d) rupturing the pore by heating hydrocarbon gas or liquid contained in the first pore via the heat from the injected steam and thereby raising the temperature of any hydrocarbon gas and of any hydrocarbon liquid in the pore sufficiently for the hydrocarbon liquid to form hydrocarbon gas and raising the pressure of the hydrocarbon gas being heated in the first pore to a level sufficient to rupture the pore, weaken the structure of the shale matrix, and form a micro-fracture in the shale matrix, wherein the micro-fracture is connected to the primary fracture, wherein the pore is located within five feet of the primary fracture and the temperature of the shale matrix surrounding the pore experiences an increase of 100 to 300 degrees Fahrenheit within a period of 1 to 7 days from when the steam enters the primary fracture at a location closest to the pore; and (f) injecting hydraulic fracturing fluid through the wellbore and into the primary fracture to form one or more macro-fractures in the shale matrix having a weakened structure by expanding or coalescing the micro-fracture during the injecting of the hydraulic fracturing fluid.

One or more specific embodiments disclosed herein include a method for recovering hydrocarbon gas through a horizontal wellbore from a shale formation section which, prior to being heated from combustion of oxidizer, comprises hydrocarbon gas with substantially no kerogen or heavy oils having an API gravity of less than 25 degrees, wherein the method includes: (a) injecting oxidizer through the horizontal wellbore and into the shale formation section, wherein the shale formation section includes a shale matrix having a structure with substantially no kerogen or heavy oils with an API gravity of less than 25 degrees, a primary fracture formed by a previous hydraulic fracturing operation, residual hydrocarbon gas in the primary fracture, and pores that contain hydrocarbon gas; (b) reacting a portion of the oxidizer with residual hydrocarbon gas in the primary fracture to form a combustion product and heat, wherein the residual hydrocarbon gas is hydrocarbon gas remaining in the primary fracture after a previous hydraulic fracturing operation; (c)transferring the heat through the shale matrix to a first and a second pore that each contain hydrocarbon gas; (d) rupturing the first pore by heating hydrocarbon gas contained in the first pore and thereby raising the pressure of the hydrocarbon gas being heated in the first pore to a level sufficient to rupture the first pore, weaken the structure of the shale matrix, and form a first micro-fracture in the shale matrix, wherein the first micro-fracture is connected to the primary fracture and contains hydrocarbon gas that is consumed by combustion, and (e) rupturing the second pore by heating hydrocarbon gas contained in the second pore and thereby raising the pressure of the hydrocarbon gas being heated in the second pore to a level sufficient to rupture the second pore, weaken the structure of the shale matrix, and form a second micro-fracture in the shale matrix, wherein the second micro-fracture is not connected to the primary fracture and contains hydrocarbon gas that is not consumed by combustion, wherein the first pore and the second pore are each located within five feet of the primary fracture and the temperature of the shale matrix surrounding the first and second pores experiences an increase of 100 to 300 degrees Fahrenheit within a period of 1 to 7 days from when the combustion product is formed in the primary fracture as a result of the reaction of the oxidizer with the residual hydrocarbon gas; (f) injecting hydraulic fracturing fluid through the horizontal wellbore and into the primary fracture to form one or more macro-fractures in the shale matrix having a weakened structure by expanding or coalescing the first and second micro-fractures during the injecting of the hydraulic fracturing fluid; and (g) recovering hydrocarbon gas that passes through the one or more macro-fractures and into the horizontal wellbore.

One or more specific embodiments disclosed herein include a method for recovering hydrocarbon gas through a horizontal wellbore from a shale formation section which, prior to being heated from combustion of oxidizer, comprises hydrocarbon gas with substantially no kerogen or heavy oils having an API gravity of less than 25 degrees, wherein the horizontal wellbore has a first wellbore section and a second wellbore section, which method includes: (a) positioning one or more packers in the horizontal wellbore such that the first wellbore section is substantially isolated from fluid communication with the second wellbore section, a first primary fracture formed by a previous hydraulic fracturing operation is connected to the first wellbore section and contains residual hydrocarbon gas, and a second primary fracture formed by a previous hydraulic fracturing operation is connected to the second wellbore section and contains residual hydrocarbon gas, wherein the first and second primary fractures are in the shale formation section that includes a shale matrix that includes pores containing hydrocarbon gas and having a structure with substantially no kerogen or heavy oils with an API gravity of less than 25 degrees; (b) positioning a conduit for delivering oxidizer to the first wellbore section; (c) injecting oxidizer through the conduit and into the first wellbore section; (d) reacting a portion of the oxidizer with residual hydrocarbon gas in the first primary fracture to form a combustion product and heat, wherein the residual hydrocarbon gas is hydrocarbon gas remaining in the first primary fracture after a previous hydraulic fracturing operation; (e) transferring the heat through the shale matrix to a first primary fracture pore that contains hydrocarbon gas; (f) rupturing the first primary fracture pore by heating hydrocarbon gas contained in the pore and thereby raising the pressure of the hydrocarbon gas being heated in the first primary fracture pore to a level sufficient to rupture the first primary fracture pore, weaken the structure of the shale matrix, and form a first micro-fracture in the shale matrix, wherein the first micro-fracture is either connected to the first primary fracture and contains hydrocarbon gas that is consumed by combustion or is not connected to the first primary fracture and contains hydrocarbon gas that is not consumed by combustion, wherein the first primary fracture pore is located within five feet of the first primary fracture and the temperature of the shale matrix surrounding the first primary fracture pore experiences an increase of 100 to 300 degrees Fahrenheit within a period of 1 to 7 days from when the combustion product is formed in the first primary fracture as a result of the reaction of the oxidizer with the residual hydrocarbon gas; (g) injecting hydraulic fracturing fluid through the horizontal wellbore and into the first primary fracture to form one or more macro-fractures in the shale matrix having a weakened structure by expanding or coalescing the micro-fractures during the injecting of the hydraulic fracturing fluid; (h) positioning the conduit for delivering oxidizer to the second wellbore section; (i) injecting oxidizer through the conduit and into the second wellbore section; (j) reacting a portion of the oxidizer with residual hydrocarbon gas in the second primary fracture to form a combustion product and heat, wherein the residual hydrocarbon gas is hydrocarbon gas remaining in the second primary fracture after a previous hydraulic fracturing operation; (k) transferring the heat through the shale matrix to a second primary fracture pore that contains hydrocarbon gas; (l) rupturing the second primary fracture pore by heating hydrocarbon gas contained in the pore and thereby raising the pressure of the hydrocarbon gas being heated in the second primary fracture pore to a level sufficient to rupture the second primary fracture pore, weaken the structure of the shale matrix, and form a micro-fracture in the shale matrix, wherein the micro-fracture is either connected to the second primary fracture and contains hydrocarbon gas that is consumed by combustion or is not connected to the second primary fracture and contains hydrocarbon gas that is not consumed by combustion, wherein the second primary fracture pore is located within five feet of the second primary fracture and the temperature of the shale matrix surrounding the second primary fracture pore experiences an increase of 100 to 300 degrees Fahrenheit within a period of 1 to 7 days from when the combustion product is formed in the second primary fracture as a result of the reaction of the oxidizer with the residual hydrocarbon gas; (m) injecting hydraulic fracturing fluid through the horizontal wellbore and into the second primary fracture to form one or more macro-fractures in the shale matrix having a weakened structure by expanding or coalescing the micro-fractures during the injecting of the hydraulic fracturing fluid; and (n) recovering hydrocarbon gas that passes through the one or more macro-fractures and into the horizontal wellbore.

One or more specific embodiments herein includes a method for recovering hydrocarbon gas from a shale formation, comprising injecting oxidizer through a horizontal wellbore into a first fracture in the shale formation, which shale formation includes confined pores containing hydrocarbon gas, and which shale formation includes a shale matrix surrounding the confined pores, injecting hydraulic fracturing fluid comprising proppants through the horizontal wellbore into the shale formation, and recovering at least a portion of the hydrocarbon gas, wherein portions of the oxidizer react with residual hydrocarbons to form a combustion product and heat, the heat from the combustion is transferred through the shale matrix to at least some of the confined pores containing hydrocarbon gas, hydrocarbon gas contained in at least some of the confined pores is heated to form heated hydrocarbon gas, and the temperature and pressure of the heated hydrocarbon gas is raised, the pressure of the heated hydrocarbon gas is raised to a level sufficient to cause a second fracture to form in the shale matrix, which second fracture is connected to at least one of the confined pores containing the heated hydrocarbon gas, at least some of the hydraulic fracturing fluid enters the second fracture, and at least some hydrocarbon gas passes from at least some of the confined pores through at least a portion of the second fracture and exits the shale formation.

One or more specific embodiments herein includes a method for recovering hydrocarbon gas from a shale formation comprising injecting oxidizer through a horizontal wellbore into a fracture in the shale formation comprising pores containing hydrocarbon gas, and recovering at least some of the hydrocarbon gas from the shale formation, wherein some of the injected oxidizer combusts and increases the temperature of a portion of the shale formation and of the hydrocarbon gas contained in at least some of the pores in the shale formation, the pressure of at least some of the hydrocarbon gas increases to a point sufficient to cause formation of new fractures, and at least some of the hydrocarbon gas passes from the pores through some of the new fractures and is recovered.

One or more specific embodiments herein includes a method for recovering hydrocarbons from a shale formation, comprising injecting oxidizer through a horizontal wellbore into a first fracture in the shale formation, which shale formation includes a shale matrix and confined pores that comprise a first group of confined pores and a second group of confined pores, wherein the first and second groups of confined pores each contains hydrocarbons, and wherein residual hydrocarbons are in the horizontal wellbore or the first fracture, or both, forming one or more second fractures, and recovering at least a portion of the hydrocarbons from the confined pores through at least one second fracture, wherein at least a portion of the oxidizer mixes with residual hydrocarbons and reacts to form a combustion product and to generate heat, at least some of the heat is transferred through the shale matrix to at least some of the first and second groups of confined pores, the temperature and pressure of at least some of the hydrocarbons contained in the first group of confined pores are raised, the pressure of at least some of the hydrocarbons contained in the first group of confined pores is raised to a level sufficient to cause formation of one or more of the second fractures, at least one of the second fractures is connected to at least one of the first group of confined pores containing hydrocarbons, at least some of the hydrocarbons in at least some of the first group of confined pores is combusted, and at least some of the hydrocarbon passes from one or more of the second group of confined pores through at least one of the second fractures and is recovered.

One or more specific embodiments herein includes a method for recovering hydrocarbon gas from a shale formation comprising injecting oxidizer through a horizontal wellbore and into a fracture present within the shale formation, which shale formation comprises a shale matrix having confined pores containing hydrocarbon gas, and recovering at least a portion of the hydrocarbon gas, wherein hydrocarbons are present in the fracture, the hydrocarbons combust in a combustion zone within the fracture to form a combustion product having a temperature of 800 Fahrenheit or more, at least a portion of the shale matrix proximate the combustion zone is heated, heat is transferred through the shale matrix to at least some of the confined pores containing hydrocarbon gas, the pressure of the hydrocarbon gas contained in the confined pores increases to a pressure sufficient to increase the permeability of the shale formation, and the hydrocarbon gas moves through at least a portion of the shale matrix and exits the shale formation.

One or more specific embodiments herein includes a method for recovering hydrocarbon gas from a shale formation comprising injecting steam having an incremental temperature of at least 100 degrees Fahrenheit higher than the initial reservoir temperature into a first fracture in the shale formation, which shale formation comprises confined pores containing hydrocarbon gas, and recovering at least a portion of the hydrocarbon gas, wherein the steam has an incremental temperature of at least 100 degrees Fahrenheit higher than the initial reservoir temperature when entering the first fracture, at least some of the heat of the steam is transferred to at least some of the confined pores in shale formation, and the heat transferred to the confined pores causes the pressure of the hydrocarbon gas within the confined pores to increase to a pressure sufficient to cause the formation of one or more second fractures connected to at least one of the confined pores.

One or more specific embodiments herein includes a method for recovering hydrocarbon gas from a shale formation comprising inserting at least one packer comprising an annular structure into a wellbore, resulting in the formation of a first wellbore section that is separated by the packer from a second wellbore section, injecting an oxidizer through the wellbore into a first fracture connected to the first wellbore section in the shale formation, which shale formation comprises a shale matrix surrounding confined pores containing hydrocarbon gas, injecting hydraulic fracturing fluid comprising proppants through the first wellbore section into the shale formation, and recovering at least a portion of the hydrocarbon gas, wherein portions of the oxidizer react with residual hydrocarbon gas to form heat, the heat is transferred through the shale matrix to at least some of the confined pores containing hydrocarbon gas, the pressure and temperature of the hydrocarbon gas is raised to a level sufficient to cause a second fracture to form in the shale formation, which second fracture is connected to at least one of the heated confined pores containing hydrocarbon gas, at least some of the hydraulic fracturing fluid enters the second fracture, and at least some of the hydrocarbon gas passes from at least some of the confined pores through at least a portion of the second fracture and exits the shale formation.

One or more of the methods disclosed herein may further comprise injecting hydraulic fracturing fluid into the first fracture after one or more second fractures are formed.

One or more of the methods disclosed herein may further comprise injecting hydraulic fracturing fluid into the first fracture after one or more second fractures is formed, wherein the hydraulic fracturing fluid comprises proppants.

In any one of the methods disclosed herein, liquid fuel may be injected prior to or contemporaneous with the injection of oxidizer into the first fracture.

In any one of the methods disclosed herein, injecting oxidizer may comprise using a compressor to pump oxidizer through the horizontal wellbore and into the first fracture.

In any one of the methods disclosed herein, injecting oxidizer may comprise using a compressor to pump oxidizer into the first fracture through the horizontal wellbore, wherein at least some of the combustion product passes from the shale formation to a second wellbore and the horizontal wellbore is connected to the second wellbore.

In any one of the methods disclosed herein, injecting oxidizer may comprise using a compressor to pump oxidizer through the horizontal wellbore and into the first fracture, and recovering at least a portion of the hydrocarbons may comprise ceasing the injection of the oxidizer and removing the hydrocarbons from the confined pore through the horizontal wellbore.

In any one of the methods disclosed herein, at least some of the hydrocarbons in the first group of confined pores may comprise hydrocarbon liquid, at least some of the heat transferred through the shale matrix to the first group of confined pores containing hydrocarbon liquid may result in the raising of the temperature of the hydrocarbon liquid contained in at least some of the first group of confined pores, the raising of the temperature of the hydrocarbon liquid contained in the first group of confined pores may result in the formation of hydrocarbon gas that has a pressure sufficient to cause the formation of the one or more second fractures connected to at least one of the first group of confined pores that contains hydrocarbon liquid, and at least a portion of the hydrocarbon liquid from at least one of the first group of confined pores may be recovered through at least one of the second fractures.

In any one of the methods disclosed herein, the portion of the oxidizer may react to generate heat for a period of time ranging from 1 day to 7 days.

In any one of the methods disclosed herein, at least some of the confined pores may contain hydrocarbon liquid, and at least some of the heat transferred through the shale matrix to the confined pores containing hydrocarbon liquid may result in the raising of the temperature of the hydrocarbon liquid to a temperature sufficient to cause at least some of the hydrocarbon liquid to reach its bubble point.

In any one of the methods disclosed herein, two or more second fractures may coalesce to form a third fracture.

In any one of the methods disclosed herein, at least a portion of the shale formation proximate the first fracture may react to generate heat.

In any one of the methods disclosed herein, one or more second fractures may be connected to the first fracture.

One or more of the methods disclosed herein may further comprise injecting hydraulic fracturing fluid into the first fracture after at least one of the second fractures is formed, wherein the hydraulic fracturing fluid may cause one or more of the second fractures to extend into the shale formation.

One or more of the methods disclosed herein may further comprise injecting hydraulic fracturing fluid into the first fracture after at least one of the second fractures is formed, wherein the hydraulic fracturing fluid may cause one or more of the second fractures to extend into the shale formation, and the extended second fracture may connect to at least one of the second group of the confined pores.

One or more of the methods disclosed herein may further comprise injecting hydraulic fracturing fluid into the first fracture after the portion of the oxidizer in the first fracture has reacted to form the combustion product and to generate heat.

In any one of the methods disclosed herein, oxidizer may be injected into the first fracture through the horizontal wellbore having a first wellbore section and a second wellbore section, both of which may be capable of being in fluid communication with the first fracture.

One or more of the methods disclosed herein may further comprise positioning one or more packers in the horizontal wellbore such that the first wellbore section is substantially isolated from fluid communication with the second wellbore section, and the oxidizer may be injected into the first wellbore section.

One or more of the methods disclosed herein may further comprise positioning one or more packers in the horizontal wellbore prior to injecting the oxidizer such that the first wellbore section is substantially isolated from fluid communication with the second wellbore section, and injecting hydraulic fracturing fluid into the first wellbore section after the one or more second fractures is formed.

In any one of the methods disclosed herein, the oxidizer may react to generate heat in the shale formation for at least a period of 6 hours, or for at least a period of 1 day, or for at least a period of 7 days, or for at least a period of 20 days.

In any one of the methods disclosed herein, the oxidizer may be injected into the shale formation for at least a period of 6 hours, or for at least a period of 1 day, or for at least a period of 7 days, or for at least a period of 20 days.

In any one of the methods disclosed herein, at least a portion of the oxidizer that is injected into the first fracture may mix with residual hydrocarbons while the portion of the oxidizer is in the first fracture.

In any one of the methods disclosed herein, injecting steam may comprise using vacuum-insulated tubing to inject the steam into the first fracture of the shale formation.

One or more of the methods disclosed herein may further comprise injecting hydraulic fracturing fluid into the shale formation after injecting steam.

One or more of the methods disclosed herein may further comprise injecting hydraulic fracturing fluid into the shale formation after the one or more second fractures is formed.

One or more of the methods disclosed herein may further comprise injecting hydraulic fracturing fluid into the first fracture after the one or more second fractures is formed, wherein the hydraulic fracturing fluid comprises proppants.

In any one of the methods disclosed herein, at least some of the confined pores may contain hydrocarbon liquid, at least some of the heat transferred to the confined pores containing hydrocarbon liquid may result in the raising of the temperature of the hydrocarbon liquid contained in the confined pores, the raising of the temperature of the hydrocarbon liquid contained in the confined pores may result in the formation of hydrocarbon gas having a pressure sufficient to cause the formation of the one or more second fractures connected to at least one of the confined pores that contains hydrocarbon liquid, and at least a portion of the hydrocarbon liquid from at least one of the confined pores may be recovered through at least one of the second fractures.

In any one of the methods disclosed herein, two or more second fractures may coalesce to form a third fracture.

In any one of the methods disclosed herein, one or more second fractures may be connected to the first fracture.

One or more of the methods disclosed herein may further comprise injecting hydraulic fracturing fluid into the first fracture after the one or more second fractures is formed, wherein the hydraulic fracturing fluid may cause at least one second fracture to extend into the shale formation.

In any one of the methods disclosed herein, the steam may be injected for at least a period of 6 hours, or for at least a period of 1 day, or for at least a period of 7 days, or for at least a period of 20 days.

Any one or more of the methods disclosed herein may include injecting fuel through the horizontal wellbore and into the shale formation section, and reacting a portion of the oxidizer with the fuel to form a combustion product and heat.

Any one or more of the methods disclosed herein may include injecting sand or manufactured proppants along with the injecting of the hydraulic fracturing fluid, such that the sand or manufactured proppants enter the macro-fractures formed as a result of the injection of the hydraulic fracturing fluid.

In any one or more of the methods disclosed herein the primary fracture may include sand or manufactured proppants or diverter agents that were injected during the previous hydraulic fracturing operation that caused the formation of the primary fracture.

In any one or more of the methods disclosed herein the injection of the oxidizer may or may not be stopped before the hydraulic fracturing fluid is injected.

4. Specific Embodiments in the Figures

The drawings presented herein are for illustrative purposes only and are not intended to limit the scope of the claims. Rather, the drawings are intended to help enable one having ordinary skill in the art to make and use the claimed inventions.

Referring to FIGS. 1-5, various aspects of methods for recovering hydrocarbons are illustrated. These methods have steps any one of which may be found in various specific embodiments, including both those that are shown in this specification and those that are not shown.

Referring to FIG. 1, a horizontal wellbore 18 is depicted as recently drilled and completed, but not yet subjected to perforation or stimulation, e.g., hydraulic fracturing. For simplicity, the horizontal wellbore in FIG. 1 and the other drawings herein are shown without any downhole elements, such as casing, tubing, or cement. As depicted in FIG. 1, the horizontal wellbore 18 has been drilled through a section of a shale formation 14 located under at least one of a number of different types of rock formations 12. The horizontal wellbore 18 may vary in length, e.g., from 100 feet to 15,000 feet or more. The shale formation 14 comprises confined pores 24 which may have hydrocarbons therein. The shale formation 14 is substantially impermeable, with a permeability often in the nanodarcy range and comparable to that found in granite, e.g., less than 1 microdarcy.

Figure 2:
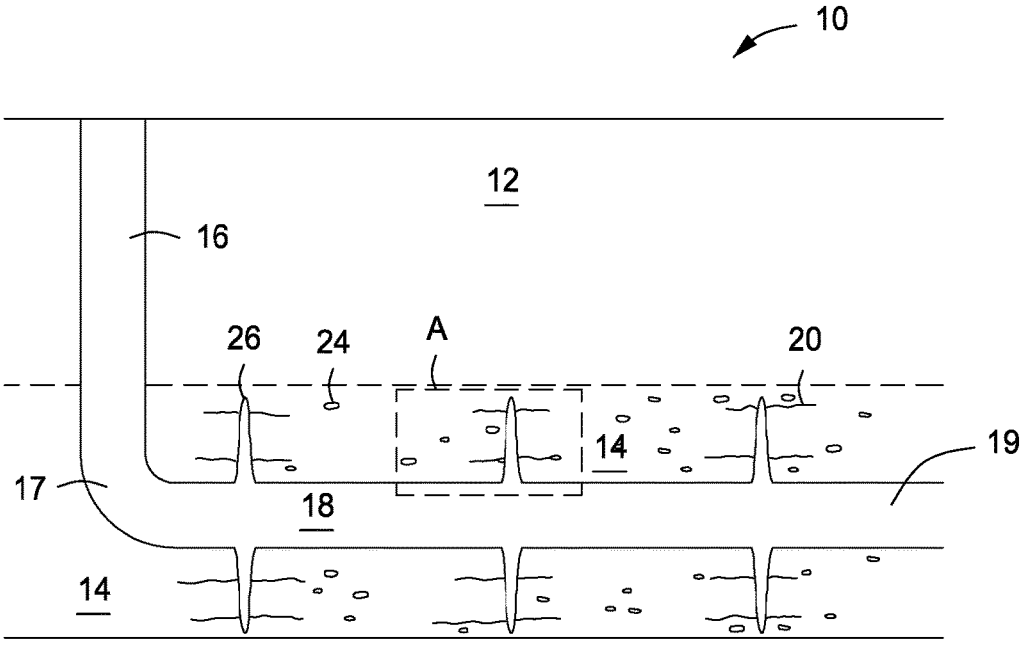
FIG. 2 is a simplified depiction of a horizontal wellbore in a shale formation after having undergone hydraulic fracturing.

Referring to FIG. 2, a horizontal wellbore 18 is depicted as recently fractured. The horizontal wellbore 18 has been fractured using hydraulic fracturing techniques well-known in the art. For purposes of discussion, horizontal wellbore 18 is shown representationally and without any of the downhole components and, as discussed above, is also not shown to scale. Hydraulic fracturing ("fracking") fluid may be pumped down the vertical portion 16 of the horizontal wellbore 18 at high pressure. The initial hydraulic fracturing operation may result in a number of fractures 26 in the shale formation 14, which fractures may be referred to from time to time herein as "primary fractures." As used herein, the term "primary fractures" means any hydraulic fractures formed prior to the injection of the oxidizer (and/or steam) as discussed herein, and these "primary fractures" may be formed as a result of more than one hydraulic fracturing operation, including an operation sometimes called "re-fracturing." Primary fractures 26 further comprise fracture wings 20, which are fractures in the shale formation 14 that are formed along the lamina of the shale formation 14. The primary fractures 26 including their fracture wings 20 may provide fluid communication between the horizontal wellbore 18 and a number of previously confined pores (shown in FIG. 1), resulting in the movement of hydrocarbons from those once-confined pores to the horizontal wellbore 18 and subsequent recovery of at least some of the hydrocarbons at the surface. A number of other confined pores 24 remain isolated with substantially no fluid communication with the horizontal wellbore 18 or the primary fractures 26. Section A in FIG. 2 is shown with greater detail in FIG. 5, described below.

Figure 3:
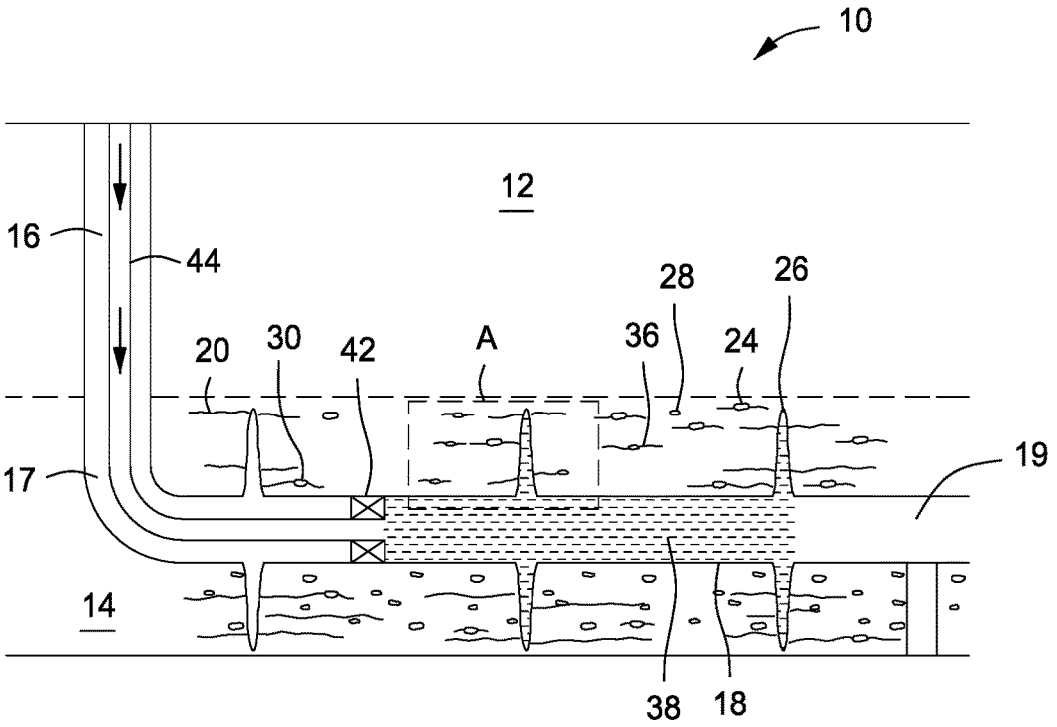
FIG. 3 is a simplified depiction of a horizontal wellbore in a shale formation undergoing air injection and combustion.

Referring to FIG. 3, a horizontal wellbore 18 is depicted as undergoing a type of "secondary" recovery, described herein, by creating thermally-induced microfractures 36 initiated by the introduction of heat as discussed below and elsewhere herein. In certain formations that have already been subjected to hydraulic fracturing and from which hydrocarbons (e.g., gas and/or light oils) have been removed (produced), certain amounts of hydrocarbons may remain, not only in the confined pores 24, but also in the horizontal wellbore 18 and primary fractures 26. The "residual" hydrocarbons may exist in the horizontal wellbore 18 and primary fractures 26 even after the well is considered to no longer be productive, e.g., after it would be considered economically impractical to recover that residual hydrocarbon. The residual hydrocarbons comprise any number of hydrocarbon components, including methane, ethane, propane, butane, pentane, etc. In some cases, if the reservoir temperature is about 180 degrees Fahrenheit or more, it is contemplated that spontaneous ignition of the residual hydrocarbons can occur by introducing an oxidizer at a sufficient partial pressure. In other cases, a separate downhole ignition source may be needed to ignite the residual hydrocarbons. In still other cases, super-heated steam may be injected in lieu of an oxidizer to heat the shale formation 14. Generally speaking, the initial temperature of the shale formation 14 (before artificial heating as described herein) will depend primarily on the depth of the shale formation 14 at that point (i.e., vertical distance to the surface). A comprehensive discussion of formation temperatures is beyond the scope of this patent disclosure, but such information can be obtained from technical literature.

An oxidizer such as air can be injected into the horizontal wellbore 18 and primary fractures 26. An air pump (compressor) may be used to inject air from the surrounding environment into the vertical portion 16 of the horizontal wellbore 18 via an inserted tubing string 44 to serve as an oxidizer for combustion reactions. Other types of oxidizers and devices for injecting oxidizers are also contemplated. A packing assembly 42 may be positioned in the wellbore 18 to prevent any combustion reaction from travelling up the wellbore 18 toward the surface. The addition of an oxidizer such as air into the horizontal wellbore 18 preferably initiates a combustion reaction 38 when the residual hydrocarbons mix with the oxidizer at an ignition temperature within the horizontal wellbore 18 at the point where mixing takes place. Additional fuel may be injected prior to or simultaneously with the injected air to increase the combustible material found in the horizontal wellbore 18 and primary fractures 26. Also, oxidizer may be injected intermittently, e.g., in stages, with a time delay between the stages.

Additional packing assemblies, also referred to as "packers," (not shown) may be positioned in the wellbore 18 to limit the combustion reaction 38 or injected steam to a specific section of the wellbore and reduce the available volume for the combustion reaction or steam and increase the pressure in the wellbore 18 and primary fractures 26. For example, at least one packing assembly may be positioned into a wellbore, resulting in the formation of a first wellbore section and a second wellbore section that is preferably not connected to the first wellbore section. Addition of another packing assembly would result in the formation of a third wellbore section that is preferably not connected to either of the first wellbore section or the second wellbore section. Similarly, addition of further packing assemblies will result in the formation of additional wellbore sections that are preferably not connected to existing wellbore sections. Alternatively, a packing assembly may be positioned within the wellbore so as to effectively increase the volume of the first wellbore section. Oxidizer may be injected through the first wellbore section into a primary fracture that is connected to the first wellbore section in the shale formation in a "targeted injection." The targeted injection of the oxidizer into a single wellbore section may be beneficial in that it permits a more uniform distribution of the oxidizer into the primary fracture connected to that wellbore section by restricting oxidizer and/or steam access to a specific zone in the shale formation proximate the wellbore section. Without the use of a packing assembly, the oxidizer may travel to preexisting channels rather than assist in the formation of new channels in the first wellbore section through greater pressurization. Because the first wellbore section is preferably not connected to the second wellbore section, no more than an insubstantial amount of oxidizer would enter the second wellbore section. The oxidizer injected into the first wellbore section may react with residual hydrocarbon gas found in the first wellbore section and combust, forming heat. The heat may be transferred through the shale matrix proximate the first wellbore section and primary fracture to one or more confined pores containing hydrocarbon gas. The addition of heat to the confined pores may raise the temperature and pressure of the contained hydrocarbon gas to a level sufficient to cause a second fracture to form in the shale formation. In some instances, the second fracture may extend from the confined pore into the shale formation without being connected to the primary fracture, effectively increasing the volume of the confined pore. In other instances, the second fracture may extend to connect to the primary fracture and result in fluid communication being established between the confined pore and the primary fracture. Hydraulic fracturing fluid comprising proppants may then be injected into the second fracture that is connected to the primary fracture through the first wellbore section and primary fracture. Injection of the hydraulic fracturing fluid may result in connecting the second fracture to one or more confined pores containing hydrocarbon gas.

After removal of the hydraulic fracturing fluid, the hydrocarbon gas in the previously confined pores may pass from the pore through at least a portion of the second fracture and exit the shale formation to be recovered.

After ignition, the residual hydrocarbons and any added fuel will preferably combust within the primary fracture system 26 for a period of time which may last several hours or even days. Heat from this combusting fuel may have a temperature exceeding 800 degrees Fahrenheit and may be sufficient to ignite the shale formation 14 itself, creating a smoldering surface at the interface between the primary fracture system 26 and the shale formation 14. The smoldering surface of the shale formation 14 may be maintained by continuing air injection for a period of time that may or may not be predetermined, e.g., days or weeks. Alternatively, superheated steam may be injected into the wellbore 18 and primary fractures 26 for a period of time to heat the shale formation proximate the wellbore 18 and primary fractures 26. Alternatively, steam and combustion may be combined in a single operation, e.g., beginning with combustion to provide the initial heating of the shale matrix, followed by injection of steam to maintain the temperature within the wellbore primary fractures. A heating method using steam is beneficial in that no combustion products are generated during the heating of the shale formation 14 and therefore do not need to be collected by a surface facility. However, in the context of certain specific embodiments, a particular benefit of combustion over steam is that the heat needed to induce the microfractures and rupture the confined pores can be created economically by injecting an oxidizer such as air so that it mixes with residual hydrocarbons already present in the wellbore and/or previously formed fractures and reacts to form combustion products and heat. The heat generated from injection of steam or combustion of the residual hydrocarbons, any added fuel, and the smoldering shale is transferred via conduction through portions of the shale formation 14 which results in an increase in temperature of those portions of the shale formation 14. For example, it is contemplated that portions of the shale formation 14 up to 5 feet from the heating zone will experience temperature increases of 100 to 300 degrees Fahrenheit within a period of 1 to 7 days. Greater temperature increases may occur with longer periods of time. The heat in those portions of the shale formation 14 (including the portions of the shale formation 14 referred to herein as the "matrix") may be transferred to the confined pores 24 containing hydrocarbon gas or light oil which has at least partially transformed to gas from the addition of heat. Accordingly, the temperature of the hydrocarbon gas/light oil trapped in confined pores 24 found in these portions of the shale formation 14 may rise. Other methods of heating the shale formation proximate the primary fractures may be used to similarly create microfractures and improve hydrocarbon recovery from shale.

The increased temperature of the trapped hydrocarbon gas and any light oils converted by heat to gas in the confined pores 24 may result in increasing pressure applied to the inner surface of the confined pores 24. For example, in accordance with the ideal gas law, where the volume of a gas remains constant, an increase in the temperature of that gas will be accompanied by a corresponding increase in pressure. Although hydrocarbon gas is not an "ideal gas" and the temperature and pressure will not correspond perfectly to the ideal gas law, it is contemplated that there will nevertheless be a rise in pressure that accompanies any rise in temperature of hydrocarbon gas within the confined pores 24. Remote pores 28 farther from the primary fractures 26 and horizontal wellbore 18 may not receive sufficient temperature increases to cause those remote pores 28 to rupture.

It is also contemplated that the pressure on or against the inner surface of at least some of the confined pores 24 will in some cases reach a pressure sufficient to cause the portion of the shale formation 14 which forms the inner surface of the confined pore 24 to rupture, forming new fractures 36 that may be referred to herein as "microfractures." This pressure may qualify as "fracture pressure," according to some definitions and usages of that term. Some of these microfractures 36 may extend such that direct or indirect fluid communication is established with the horizontal wellbore 18 which may cause hydrocarbon gas in at least some of the confined pores 24 to be released into the horizontal wellbore 18. The hydrocarbons found within these so-called "sacrificial" pores 30 that are in fluid communication with the primary fracture 26 will likely be lost to combustion and not produced. However, the rupture of the sacrificial pores 30 may serve to create weak points in the shale formation 14 which may be exploited during a subsequent hydraulic fracturing (re-frac) to form new, larger fractures. It is contemplated, however, that some of microfractures 36 may extend but not result in establishment of fluid communication with the horizontal wellbore 18. The hydrocarbons within confined pores 24 that are not combusted may be recovered upon subsequent hydraulic fracturing. If heating is performed by injection of steam, no hydrocarbons need be "sacrificed" to a combustion reaction, and hydrocarbons in these confined pores 30 may be recovered as well. Section A in FIG. 3 is shown with greater detail in FIG. 6, described below.

Figure 4:
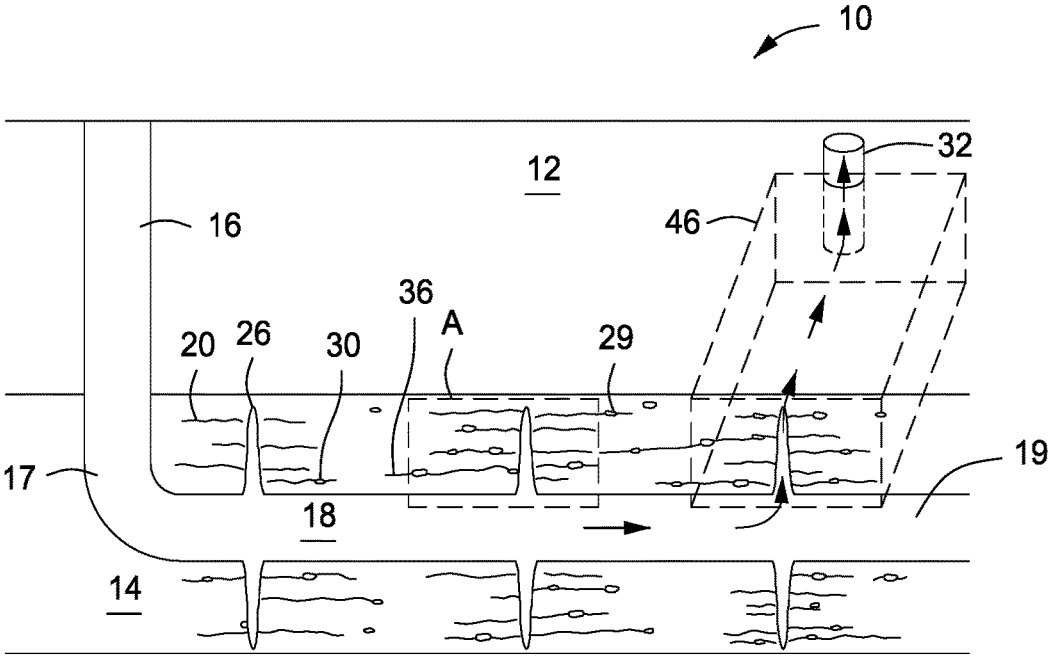
FIG. 4 is a simplified depiction of a horizontal wellbore in a shale formation after having undergone heating by combustion reaction and subsequent hydraulic fracturing.

Referring to FIG. 4, a horizontal wellbore 18 is depicted after having undergone a hydraulic fracturing process after being subjected to one of the heating operations described herein. Portions of the shale formation 14 that were heated from the earlier combustion reaction or steam injection will have microfractures 36 which tend to weaken the integrity of that portion of the shale formation 14. Application of subsequent hydraulic fracturing (re-frac) may result in new fractures 40 which may be referred to herein as "macrofractures." A macrofracture 40 may form between a previously ruptured pore 30 and a confined pore 24 such that fluid communication is established between the primary fracture 26 and the confined pore 24, and the hydrocarbons in the confined pore 24 are released and may be produced. The macrofractures 40 may result in establishment of fluid communication with previously untapped portions of the shale formation 14 preferably resulting in increased hydrocarbon recovery.

Exhaust gases may exit the shale formation 14 as fluids flow through the shale formation 14 to a nearby vent wellbore 32. The vent wellbore 32 may have been drilled after formation of the primary fractures 26 to be used in some type of supplemental recovery operation as discussed herein, e.g., secondary recovery. Alternatively, the vent wellbore 32 may have been a preexisting wellbore that is being repurposed for use in supplemental recovery as outlined herein. As depicted in FIG. 4, the vent wellbore 32 is shown as passing through a section of the shale formation 14 depicted as an isometric projection out of the plane containing the horizontal wellbore 18, indicating that exhaust gas and/or hydrocarbons may move through openings the shale formation 14 to a vent wellbore 32. A vent wellbore 32 useful for the purposes described herein should be sufficiently close to the horizontal wellbore 18 so that the two wellbores 18, 32 will be in fluid communication, e.g., wherein exhaust gases and other fluids can pass from horizontal wellbore 18 to the vent wellbore 32 via one or more voids, e.g., some of the primary fractures 26, their fracture wings 20, or other channels within the formation, including any of the microfractures as discussed herein. Section A in FIG. 4 is shown with greater detail in FIG. 7, described below.

Figure 5:
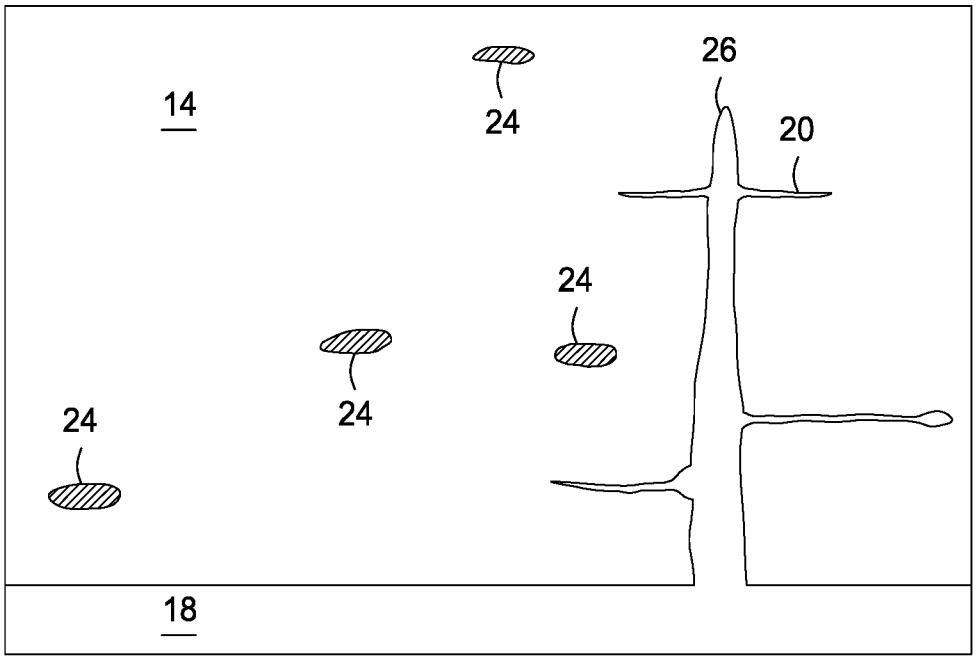
FIG. 5 is a close-up depiction of inset A of FIG. 2 depicting a primary fracture and confined pores in the matrix of the shale formation.
Figure 6:
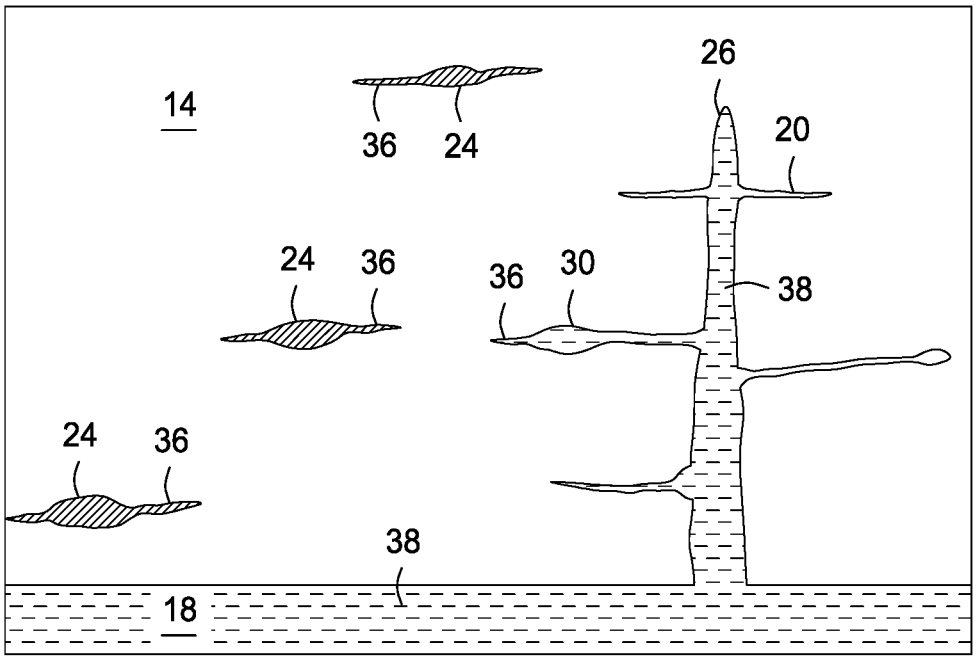
FIG. 6 is a close-up depiction of inset A of FIG. 3 depicting a primary fracture and confined pores in the matrix of the shale formation that are being heated by combustion reaction.
Figure 7:
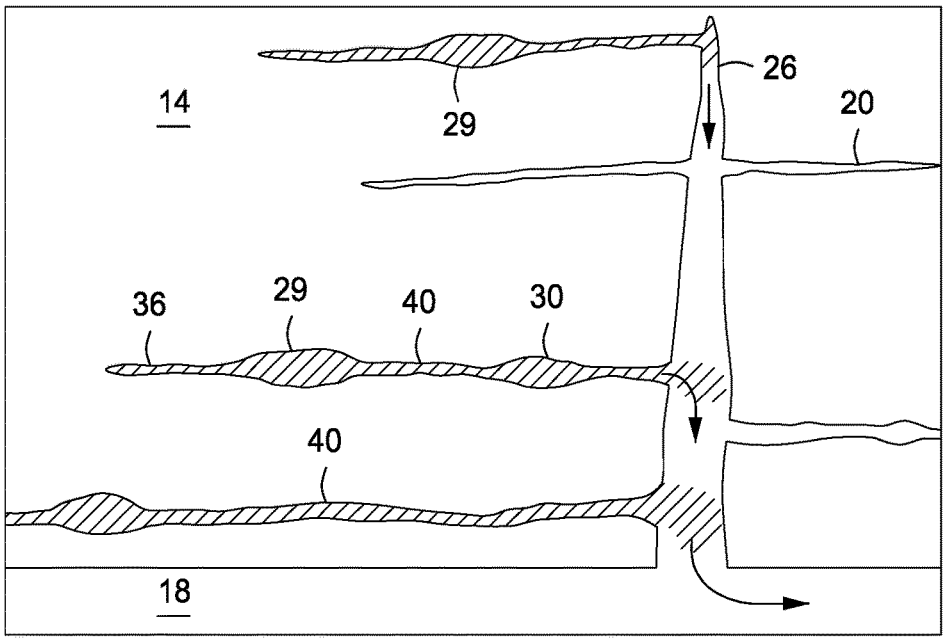
FIG. 7 is a close-up depiction of inset A of FIG. 4 depicting a primary fracture and confined pores in the matrix of the shale formation after having undergone heating by combustion reaction and subsequent hydraulic fracturing.

Referring to FIGS. 5, 6, and 7, close up depictions of section A labelled in FIGS. 2-4 are illustrated. Referring to FIG. 5, several confined pores 24 and a primary fracture 26 are depicted. As described above, the primary fracture 26 may be formed from a primary recovery process of a first hydraulic fracturing. The primary fracture 26 may extend into the shale formation 14 up to 500 feet or more from the horizontal wellbore 18. The confined pores 24 may encapsulate trapped hydrocarbons. Prior to heating by any combustion reaction or steam injection, hydrocarbons within the confined pores 24 are contemplated to exist at a substantially constant pressure, e.g., the "initial reservoir pressure" of the formation. This pressure may be related to a variety of factors but is primarily a function of the depth of the formation and its geologic history.

Referring to FIG. 6, several confined pores 24, 30 and a primary fracture 26 during a combustion reaction 38 are depicted. Some confined pores 24, 30 will be within 5 feet of the primary fracture, and it is contemplated that sufficient heat can reach at least these confined pores 24, 30 to cause the desired pressure increase. The combustion reaction 38 may continue within the horizontal wellbore 18 travelling through the horizontal wellbore 18 and into the primary fractures 26 where residual hydrocarbons or previously injected fuel is located. The combustion reaction 38 results in the heating of the shale formation 14, the confined pores 24, 30, and the hydrocarbon gas within the confined pores 24, 30. Application of heat to the shale formation 14 surrounding the confined pores 24, 30 will result in increasing the temperature of the hydrocarbon gas within the confined pores 24, 30. The increase of temperature of the hydrocarbon gas will result in a corresponding increase in pressure of the hydrocarbon gas (which may have been generated from application of heat to light oil) within the confined pores 24, 30. This increase in pressure may be sufficient to cause the shale formation 14 surrounding the confined pores 24, 30 to rupture, forming microfractures 36. In FIG. 6, the shale formation 14 surrounding the confined pores 24, 30 is substantially impermeable (permeability may be less than 1 microdarcy, often between 1 and 500 nanodarcys). Therefore, the volume of the confined pores 24, 30 is substantially fixed prior to heating. These microfractures 36 may increase the volume of the space adjacent to the confined pores 24, 30 effectively enlarging the pores from their pre-ruptured size. In some instances, rupture of confined pores 30 may result in fluid communication being established between those pores 30 and the primary fracture 26. Thus, as depicted in FIG. 6, pore 30 is no longer "confined." The hydrocarbon gas within these "sacrificial" pores 30 may then be released from the pores 30 and consumed by combustion. On the other hand, the confined pore 24 may rupture without the establishment of fluid communication with the primary fracture 26. After this initial rupture, the hydrocarbon gas may continue increasing in temperature, resulting in a corresponding increase in pressure in the confined pore 24. The increased pressure may be sufficient to cause pore 24 and the shale formation 14 surrounding the confined pore 24 to rupture further, resulting in the formation of additional microfractures 36 or expansion of existing microfractures 36. Additional ruptures may occur in a similar fashion as heat is applied.

Referring to FIG. 7, a portion of the shale formation 14 is depicted following a subsequent hydraulic fracturing (refrac). During the subsequent hydraulic fracturing, the microfractures 36 formed in the shale formation 14 around the confined pores 24 will act as weak points in the shale formation 14. The pressure generated by the subsequent hydraulic fracturing may result in the production of macrofractures 40 forming in the shale formation 14 along microfractures 36 previously formed during heat application and rupturing of sacrificial pores 30, essentially expanding and/or coalescing these microfractures 36. Fluid communication may have been established between newly ruptured pores 29 and the horizontal wellbore 18 through the formation of macrofractures 40 between sacrificial pores 30 and the primary fracture 26 and/or the horizontal wellbore 18. Additionally, macrofractures 40 may form at the primary fracture 26 and extending into the shale formation 14 to newly ruptured pores 29, thereby releasing any hydrocarbon gas therein and increasing the ultimate hydrocarbon recovery of the well. Proppants (not shown) included with the fracturing fluid slurry, prevent closure of newly formed macrofractures, providing good permeability for gas flow in the fracture system. Proppants usually consist of sand, but can be other materials such as treated sands or ceramics. A comprehensive discussion of hydraulic fracturing fluid composition is beyond the scope of this patent disclosure, but such information can be obtained from technical literature. After removal of fracturing fluid, the proppants remain and the hydrocarbon gas previously trapped within newly ruptured pores 29 exits these pores 29 and freely flows through one or more of these macrofractures 40, through the primary fracture 26, through the horizontal wellbore 18, and/or through the vent wellbore 32 to exit the shale formation 14.

Figure 8:
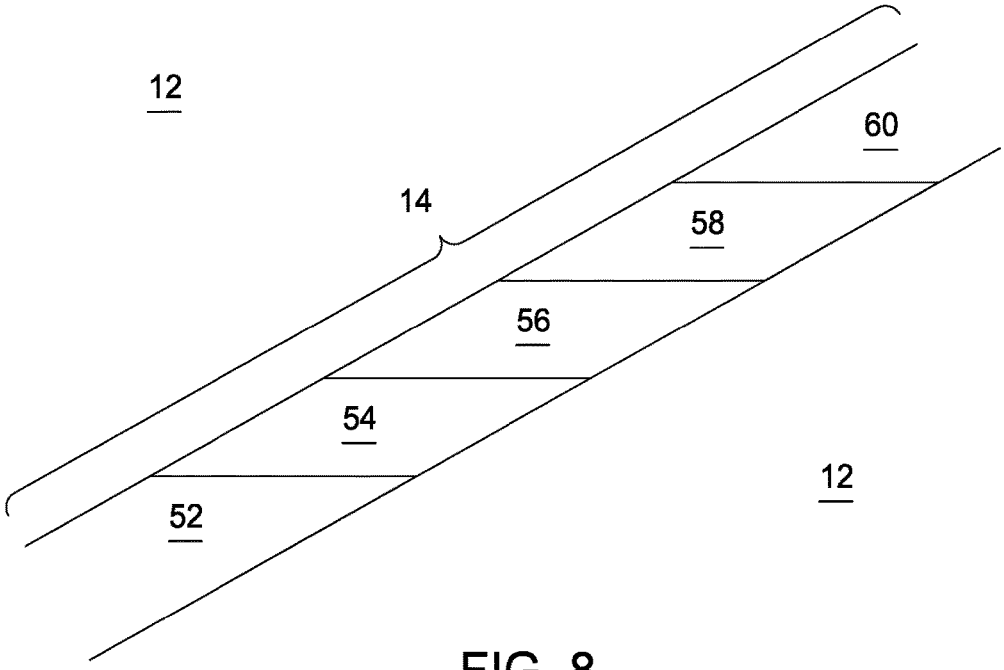
FIG. 8 is a simplified depiction of a shale formation demonstrating certain characteristics of hydrocarbons in a hypothetical shale sequence at various depths.

Referring to FIG. 8, a simplified depiction of a shale formation 14 is illustrated. A shale formation 14 is a type of substantially impermeable rock formation found among other rock formations 12. The depth of the shale formation 14 may be indicative of the properties of the hydrocarbons found within the shale formation 14. The type of hydrocarbons found in shale is typically dependent upon the shale's depth and thermal maturity. In theory, all shales initially contained decayed organic matter. Over geologic time, the shales were buried and exposed to heat from the earth's core, the deeper the burial, the higher the temperatures. The least mature shales contain kerogen, a semi-solid material similar to petroleum jelly. Kerogen is followed in maturation by heavy oils (tars), medium oils (motor oils), light oils (lighter fluids), and then natural gas. Natural gases may also contain condensate which is gas at reservoir temperatures and pressures but condenses out as a light liquid on the surface.

For example, in a shale formation 14, section 60 may comprise immature hydrocarbons in the form of semi-solid kerogen. Section 58 (which may be deeper underground than section 60) may comprise liquid hydrocarbons in the form of heavy oils. Heavy oils typically have an API gravity ranging from 10 degrees to 25 degrees. As with kerogen, heavy oils may also be heated to reduce their viscosity. Section 56 (which may be deeper underground than section 58) may comprise liquid hydrocarbons in the form of medium oils. Medium oils typically have an API gravity ranging from 25 degrees to 40 degrees. Section 54 (which may be deeper underground than section 56) may comprise liquid hydrocarbons in the form of light oils. Light oils typically have an API gravity ranging from 40 degrees to 55 degrees, such as lighter fluid. Section 52 (which may be deeper underground than section 54) may comprise hydrocarbon gas. The methods outlined herein primarily focus on recovery of hydrocarbons in this section of the shale formation 14. Hydrocarbon gas may also contain condensate. Condensate is a gas when located in the shale formation 14 at formation depth, pressure, and temperature which condenses out as a liquid at the earth's surface, or occasionally in the formation as the formation pressure is reduced. Condensate API gravities are generally greater than 50 degrees API.

With reference to FIG. 8, the methods described herein are directed to recovery of the hydrocarbon gas and, in some cases, light oils. The hydrocarbon gas may include "wet gas." For example, in a shale formation 14, light oils may be capable of transitioning to a gaseous phase upon application of heat ranging from 100 degrees Fahrenheit to 350 degrees Fahrenheit above initial reservoir temperatures. Certain methods outlined herein may thus be used to recover light oils that are close to their bubble point before being heated, provided the heat that is applied is sufficient to cause the light oil to form gas. However, the methods described herein generally should not apply to recovery of other types of hydrocarbons from confined pores. For example, kerogen is generally not recovered using the methods described herein, and any heating of kerogen will merely reduce its viscosity, but the low permeability of the shale, among other factors, will not permit recovery of even the reduced-viscosity kerogen using the methods described herein. Similarly, heavy oils are generally not producible from shales due to the low permeability of shale formations 14 even after heating of the heavy oils to reduce their viscosity. Although heavy oils may be producible from conventional reservoirs (sandstones and limestones) when heat is applied from steam injection, technology applicable to that type of production is not necessarily applicable for recovery of heavy oils from shale, and such technology is distinct from the methods described herein.

Figure 9:
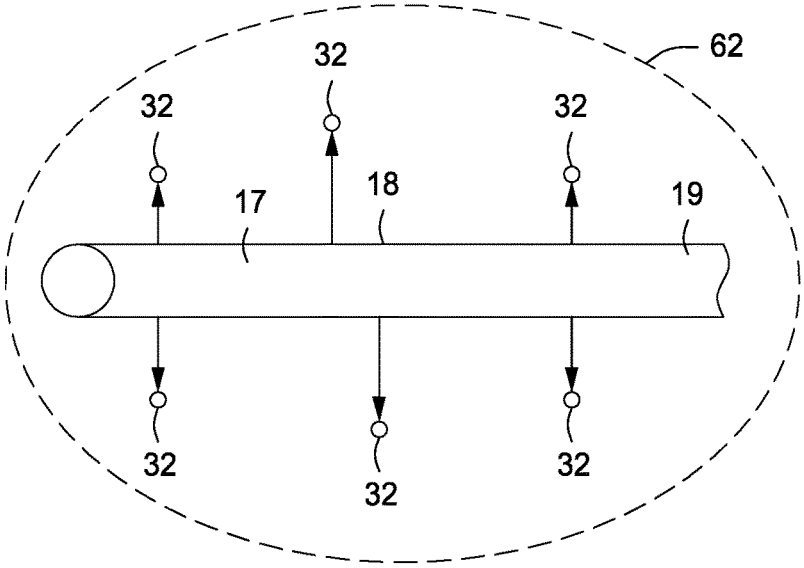
FIG. 9 is a simplified depiction of a layout of a horizontal injection wellbore and several vertical wellbores in fluid communication with the horizontal wellbore as viewed from a surface perspective.
Figure 10:
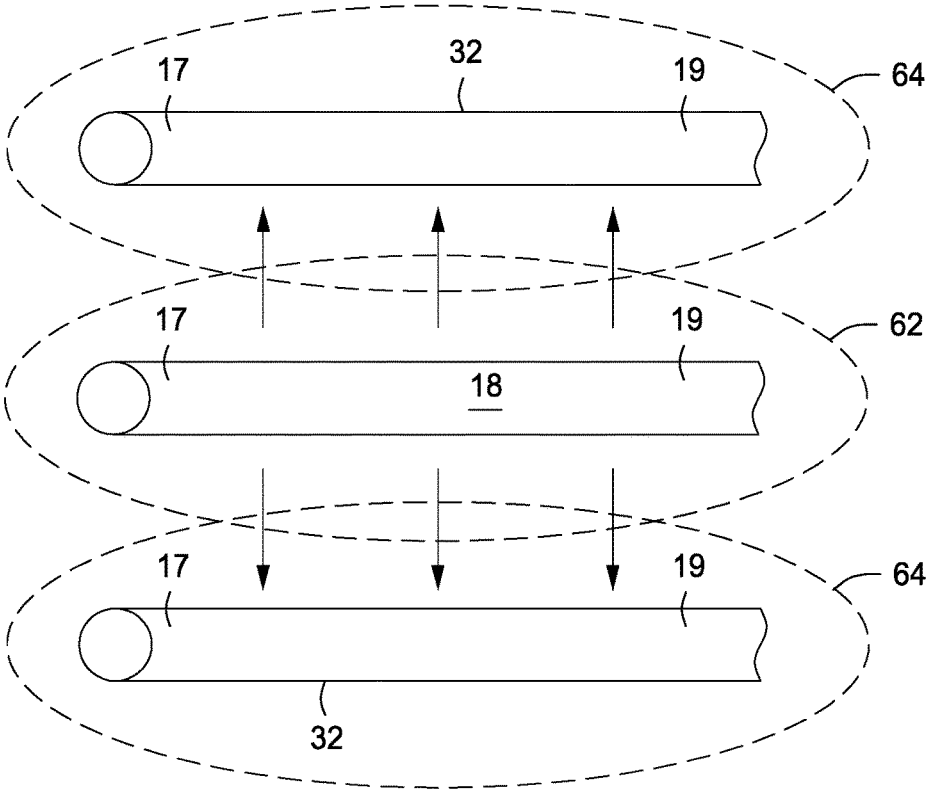
FIG. 10 is a simplified depiction of a layout of horizontal wellbores including one injection wellbore and two offset horizontal wellbores which are in fluid communication with the injection wellbore as viewed from a surface perspective.

Referring to FIGS. 9 and 10, possible layouts of the injection and vent wellbores are depicted, which have features any one of which may be found in various specific embodiments, including both those that are shown in this specification and those that are not shown.

Referring to FIG. 9, an example of a layout of an injection wellbore 18 and several vertical vent wellbores 32 is depicted. The injection wellbore 18 may be a horizontal wellbore into which air is injected. A zone of fluid communication 62 exists around the horizontal wellbore 18 where fractures and channels were previously created during stimulation. To permit combustion products to exit the wellbore during the combustion process, one or more vent wellbores 32 may exist or be drilled within the zone of fluid communication 62. The air injection and combustion process will force at least some combustion products from the injection well 18 and out of the shale formation where they may be collected at surface facilities. It is contemplated that a single vent wellbore 32 would be sufficient for this function, but multiple vent wellbores 32 may have benefits including a more even distribution of the applied heat to the shale formation. After combustion and a subsequent hydraulic fracturing, the vent wellbores 32 may provide an alternate pathway for produced hydrocarbons to exit the shale formation.

Referring to FIG. 10, an example of a layout of an injection wellbore 18 and two offset horizontal vent wellbores 32 is depicted. Horizontal wellbores are often drilled in close proximity to one another to ensure hydrocarbon recovery from the greatest percentage of the shale formation during a primary recovery operation. In one specific embodiment, a horizontal wellbore positioned between two offset horizontal wellbores is used as the injection wellbore 18, and one or more horizontal vent wellbores 32 proximate the injection wellbore 18 may serve as exit paths out of the shale formation for combustion products and/or produced hydrocarbons. Fluid communication should exist between the injection wellbore 18 and the vent wellbores 32. In other words, the zone of fluid communication 62 of the injection wellbore 18 created during primary recovery should overlap with the zones of fluid communication 64 of the vent wellbores 32.

Combustion products form during combustion of the residual hydrocarbons and may be removed from the wellbore to facilitate continued injection of the oxidizer. Combustion products can exit the wellbore in various ways. For example, if immediate offset wellbores are present with overlapping stimulated areas with the injection wellbore, there may be sufficient connection between the two such that gases in the injection wellbore are capable of flowing into the offset wellbores. Alternatively or in addition to any offset wellbores, one or more vertical vent wellbores can be drilled in the stimulated area of the injection well such that the vent wellbores are in fluid communication with the injection wellbore, and the combustion products in the injection wellbore can exit the formation through the vertical vent wellbores. In another example, the air pump can be used to inject oxidizer into the wellbore until a certain pressure is reached. At that time, the injection of oxidizer will be ceased, and the flow reversed, causing the combustion products in the wellbore to flow out of the wellbore where they may be collected at a surface facility. The process can then be repeated one or more times to continue the combustion reaction where oxidizer is injected once more into the wellbore, the combustion reaction advances further into the shale formation, and then the subsequent flow reversals cause the combustion products to exit the shale formation.

Figure 11:
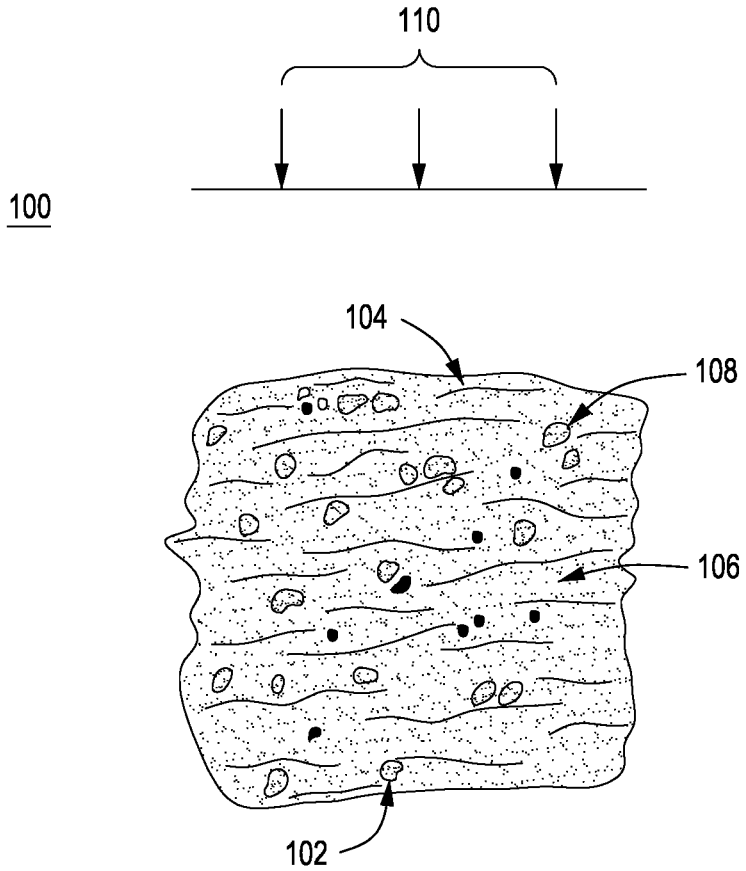
FIG. 11 illustrates confined pores within a shale matrix in representative form.

Referring to FIG. 11, a section of Utica shale 100 in Ohio is depicted with confined pores 102 in a surrounding shale matrix material 104. The reservoir temperature 106 is depicted at 154° F. with a pore pressure 108 of 5760 psia at 8000 feet. For purposes of calculation, pore rupture pressure 110 is assumed to be equal to actual measurements of hydraulic fracture pressure in nearby wells, which in this particular case, is also assumed to be equal to the local overburden pressure 110. (The terms frac pressure, hydraulic fracture pressure, fracture pressure and pore rupture pressure are used interchangeably herein.) In this case, the hydraulic fracture pressure 110 was measured to be 8160 psia. In certain other shale formations, the pore rupture pressure is less than overburden pressure.

Figure 12:
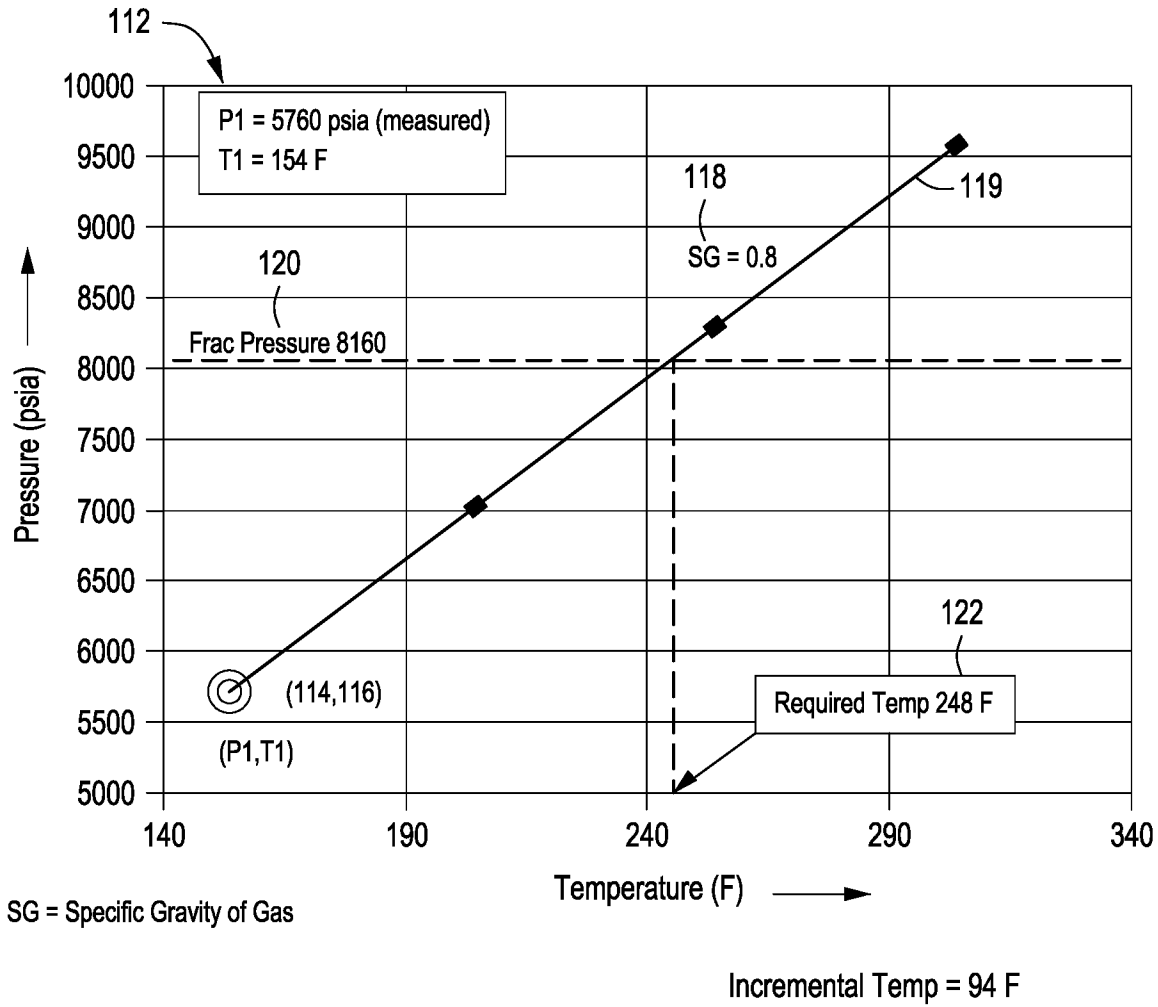
FIG. 12 is a plot of pressure versus temperature within a hypothetical confined pore in the Utica formation for a single hydrocarbon mixture having a specific gravity of 0.8. A reference line for the pore rupture pressure (frac pressure) is also provided.

Referring to FIG. 12, a plot showing how pressure would generally increase with increasing temperature using a version of the Ideal Gas Law for a constant volume case is presented for a hypothetical confined pore in the Utica shale. Pressure is displayed on the y axis and temperature on the x axis. Initial reservoir conditions are assumed to be pore pressure 114 of 5760 psia and a reservoir temperature 116 of 154° F. It is also assumed that the confined pores within the shale contain a hydrocarbon gas mixture with a specific gravity 118 of 0.8. For example, a mixture of methane, ethane and possibly some other hydrocarbon gases could have a specific gravity of 0.8. Beginning with the initial conditions 114 and 116, the temperature is depicted as being increased in 50 degree increments. The solid line 119 is an extrapolation of the temperature and pressure points for that increase. The dashed horizontal reference line at 8160 psia is pore rupture pressure 120. The intersection of these two lines is the pore rupture temperature 122. In this case, the pore rupture temperature is determined to be 248° F. which is an incremental increase of only 94° F. from the initial reservoir temperature of 154° F., demonstrating that rupturing the target pores by heating the shale matrix in accordance with the methods disclosed herein is achievable.

Figure 13:
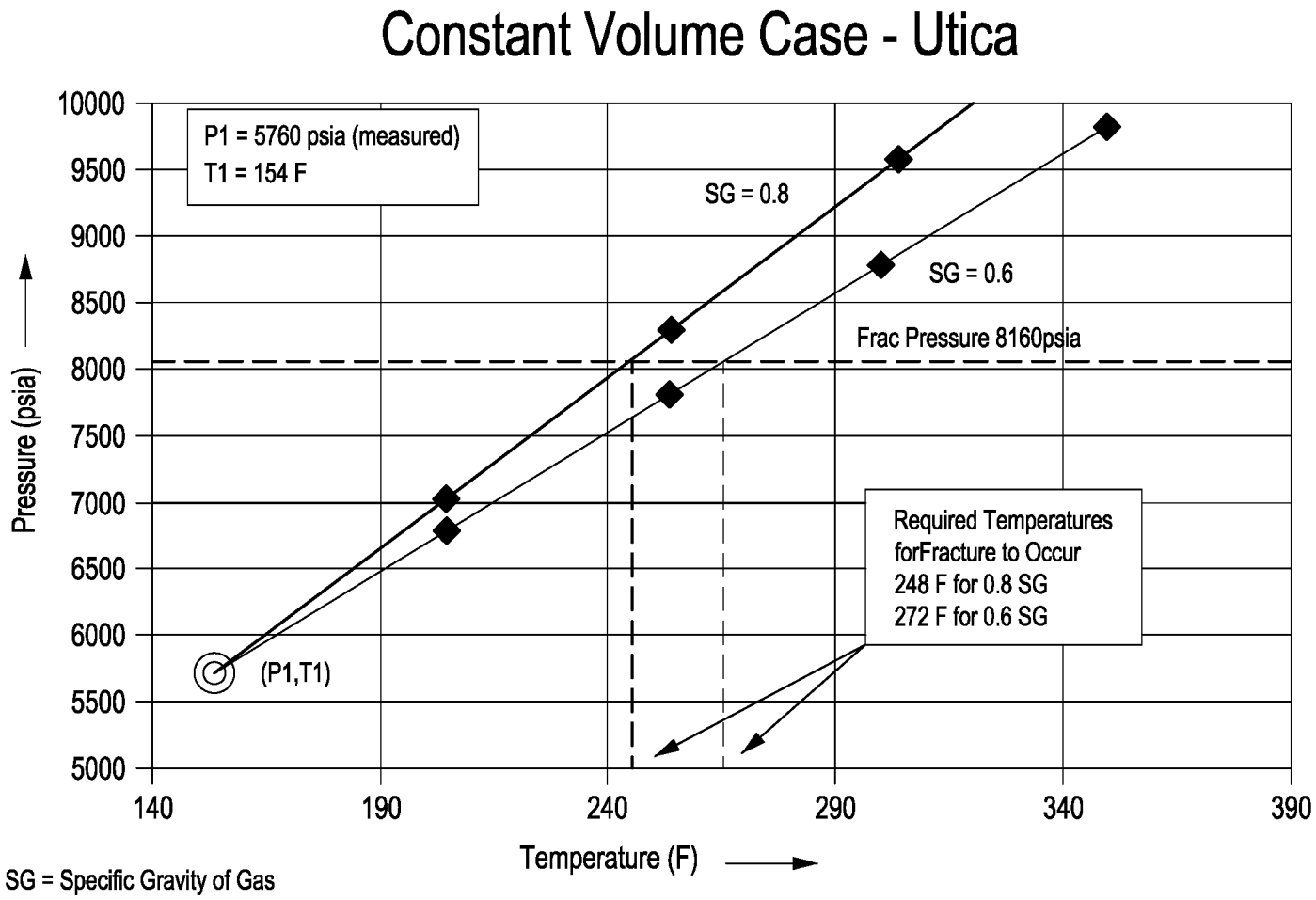
FIG. 13 is a plot of pressure versus temperature within a hypothetical confined pore in the Utica formation for two different hydrocarbon mixtures each having different specific gravities (0.6 and 0.8). Reference lines for pore rupture pressures (frac pressures) are also provided.
Figure 14:
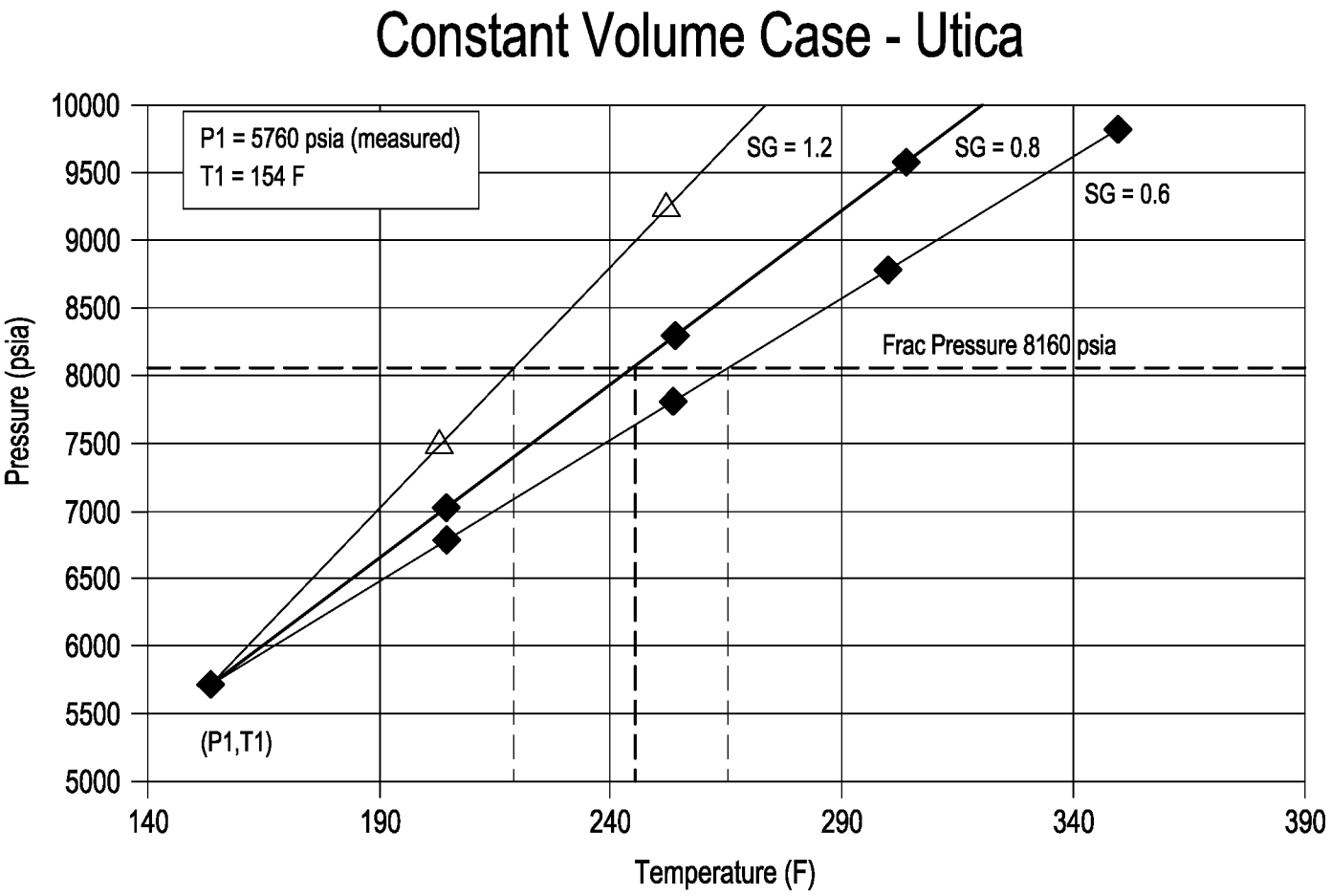
FIG. 14 is a plot of pressure versus temperature within a hypothetical confined pore in the Utica formation for three different hydrocarbons mixtures each having different specific gravities (0.6, 0.8, and 1.2). Reference lines for the pore rupture pressures (frac pressures) are also provided.

FIGS. 13-14 add similar pressure and temperature plots for two different gases with specific gravities of 0.6 and 1.2 in the Utica formation. In the context of FIGS. 13-14, it has been observed that heavier gases (e.g., those with SG of 1.2) generally require lower temperatures to reach fracture pressure than do lighter gases (e.g., those with SG of 0.6). In FIG. 14, it is contemplated that the points and extrapolated line for the SG=1.2 mixture will be different when the mixture is in the liquid state than when it is in the gaseous state, after it has been heated. When the mixture is in the liquid form, the Ideal Gas Law will not apply and the Ideal Gas Law will apply at least more closely to the mixture once the mixture becomes a gas, after sufficient heating.

Figure 15:
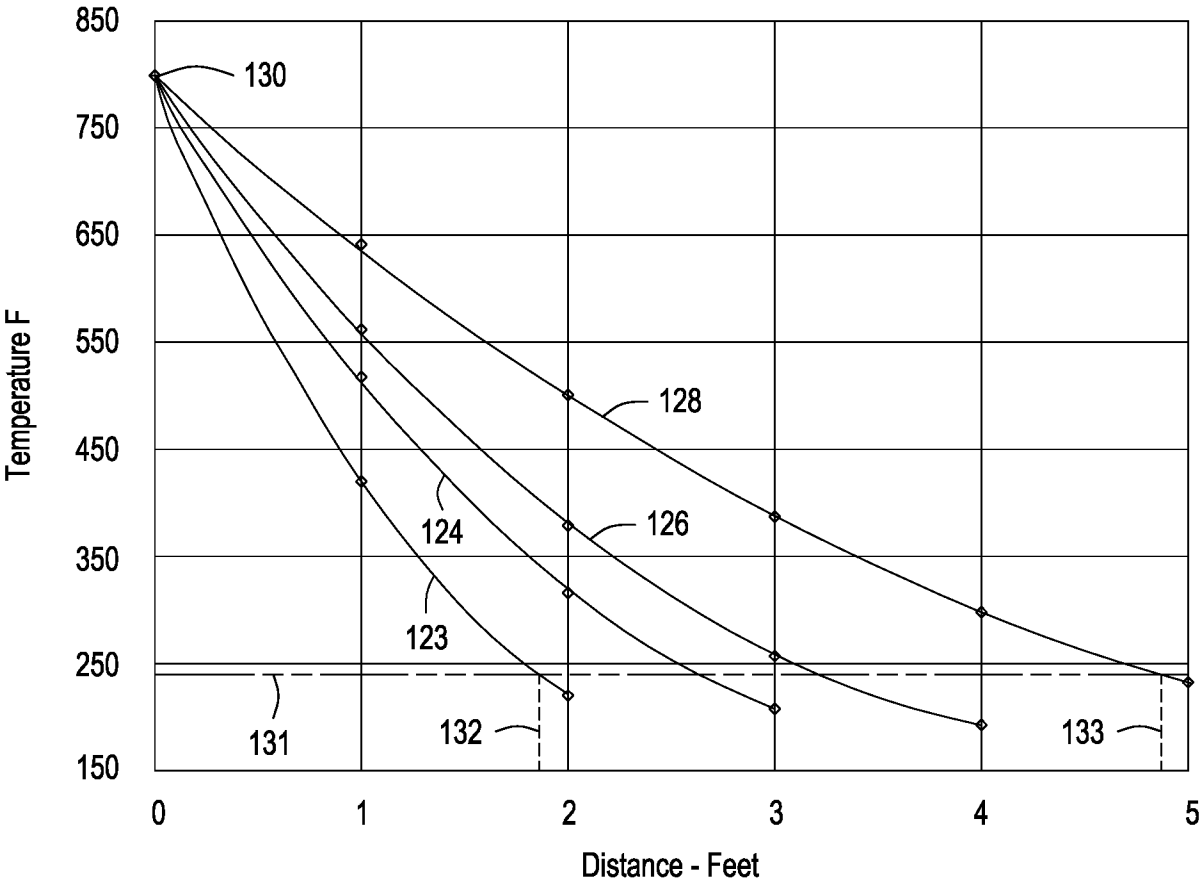
FIG. 15 is a plot of shale matrix temperature versus distance from a heated surface of a hypothetical primary fracture within the shale matrix after 1 day, 2 days, 3 days and 7 days. A reference line is provided showing the pore rupture temperature.

Referring to FIG. 15, a graphical solution to the heat transfer equation is presented. The heat transfer equation in one dimension is shown below, $$\frac{\partial T}{\partial \tau} = \alpha \frac{\partial^2 T}{\partial x^2}$$

where T is temperature, x is distance, $\tau$ is time and $\alpha$ is the thermal diffusivity of the material. This equation can be imagined as a slab of known thickness in the x dimension but infinite in the y dimension. If a heat source is suddenly applied to one side of the slab, the temperature at a point x within the slab can be determined after some elapsed time, $\tau$. The solution to this equation is an infinite Fourier series. Solving for the first 50 terms of this equation results in a family of curves as shown in FIG. 15. Each curve represents a different value of time: 1 day (123), 2 days (124), 3 days (126), and 7 days (128). The horizontal axis of the graph is distance measured in feet and the vertical axis is temperature measured in Fahrenheit. Note that each member of the curve family has the same starting point which is the temperature of the heated surface 130. In this case, the temperature of the heated surface at the interface between the primary fracture and the surrounding shale matrix is assumed to be 800° F. A horizontal reference line 131 at 248° F. is the pore rupture temperature determined from FIG. 12. Microfractures will form at all temperatures above this reference line. The intersection of this line with each member of the curve family represents the maximum distance that microfractures have occurred after that amount of time. As can be seen after 1 day of heating, microfractures are expected to be formed at a distance 132 just short of 2 feet from the heated surface; and after 7 days at distance 133, just short of 5 feet.

Figure 16:
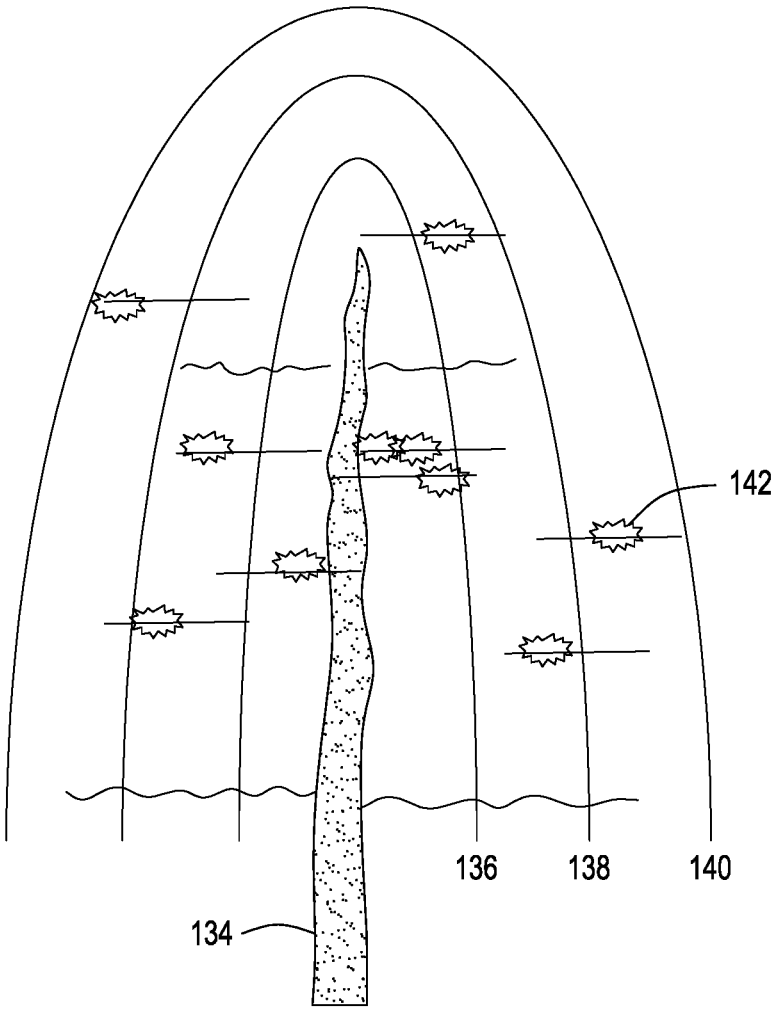
FIG. 16 is a schematic drawing of an area surrounding a hypothetical primary fracture after 1 day, 2 days and 3 days of heating. Ruptured pores are depicted.

Referring to FIG. 16, a schematic is shown of the heat distribution around a primary fracture 134 after heat has been applied at 1 day (136), 2 days (138), and 3 days (140). Ruptured pores 142 are depicted throughout.

Figure 17:
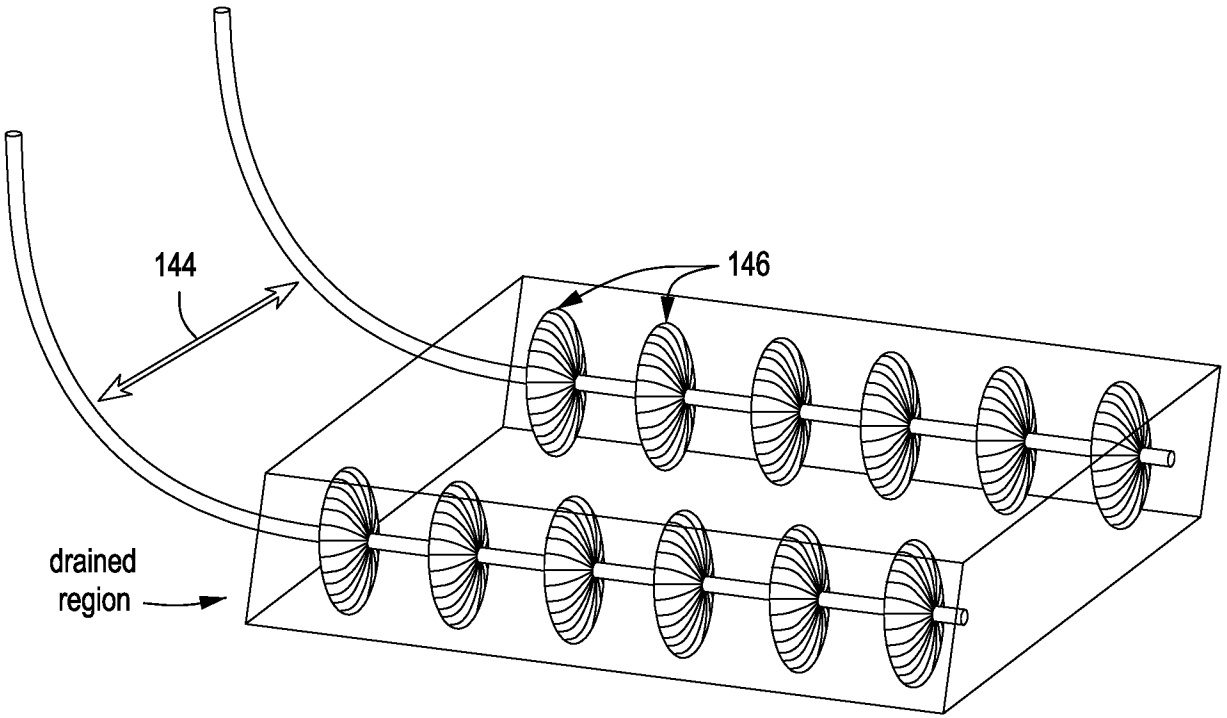
FIG. 17 is a schematic drawing of two horizontal wells having dilated areas associated with earlier primary hydraulic fracture stages.

Referring to FIG. 17, a more sophisticated image of hydraulic fracturing with 2 horizontal wells 144 is depicted. The dilated areas 146 represent hydraulic fractures where much of the proppant (sand) is located. The dilated areas 146 can be imagined as potential "ovens" for microfracture formation, containing significant amounts of sand, fuel, and broken shale. The box surrounding these two wells is the effective drainage region 148.

What is claimed as the invention is:

1. A method for hydraulically re-fracturing a shale formation section which, prior to being heated from combustion of oxidizer, comprises hydrocarbons with substantially no kerogen or heavy oils having an API gravity of less than 25 degrees, comprising:

(a) injecting oxidizer through a horizontal wellbore and into the shale formation section, wherein the shale formation section includes a shale matrix having a structure with substantially no kerogen or heavy oils with an API gravity of less than 25 degrees, a primary fracture formed by a previous hydraulic fracturing operation, residual hydrocarbons in the primary fracture, and pores that contain hydrocarbons and substantially no kerogen or heavy oils having an API gravity of less than 25 degrees;

(b) reacting at least a portion of the oxidizer with residual hydrocarbons in the primary fracture to form a combustion product and heat, wherein the residual hydrocarbons are hydrocarbons remaining in the primary fracture after a previous hydraulic fracturing operation;

(c) transferring the heat through the shale matrix to a first and a second pore that each contain hydrocarbon gas or liquid;

(d) rupturing the first pore by heating hydrocarbon gas or liquid contained in the first pore and thereby raising the temperature of any hydrocarbon gas and of any hydrocarbon liquid in the first pore sufficiently for the hydrocarbon liquid to form hydrocarbon gas and raising the pressure of hydrocarbon gas being heated in the first pore to a level sufficient to rupture the first pore, weaken the structure of the shale matrix, and form a first micro-fracture in the shale matrix, wherein the first micro-fracture is connected to the primary fracture and contains hydrocarbon gas or liquid that is consumed by combustion, (e) rupturing the second pore by heating hydrocarbon gas or liquid contained in the second pore and thereby raising the temperature of any hydrocarbon liquid in the second pore sufficiently for the hydrocarbon liquid to form hydrocarbon gas and raising the pressure of the hydrocarbon gas being heated in the second pore to a level sufficient to rupture the second pore, weaken the structure of the shale matrix, and form a second micro-fracture in the shale matrix, wherein the second micro-fracture is not connected to the primary fracture and contains hydrocarbon gas or liquid that is not consumed by combustion;

wherein the first pore and the second pore are each located within five feet of the primary fracture and the temperature of the shale matrix surrounding the first and second pores experiences an increase of 100 to 300 degrees Fahrenheit within a period of 1 to 7 days from when the combustion product is formed in the primary fracture as a result of the reaction of the oxidizer with the residual hydrocarbons; and (f) injecting hydraulic fracturing fluid through the wellbore and into the primary fracture to form one or more macro-fractures in the shale matrix having a weakened structure by expanding or coalescing the first and second micro-fractures during the injecting of the hydraulic fracturing fluid.

2. The method of claim 1 wherein the oxidizer is injected to the wellbore through a conduit.

3. The method of claim 2 wherein the hydraulic fracturing fluid is injected to the wellbore through the same conduit as the oxidizer.

4. The method of claim 1 wherein the oxidizer is injected to the wellbore through a first conduit and the hydraulic fracturing fluid is injected to the wellbore through a second conduit.

5. The method of claim 1 additionally comprising recovering hydrocarbon gas that passes through the one or more macro-fractures and into the horizontal wellbore.

6. The method of claim 1 additionally comprising injecting fuel through the horizontal wellbore and into the shale formation section, and reacting a portion of the oxidizer with the fuel to form a combustion product and heat.

7. The method of claim 1 additionally comprising injecting sand or manufactured proppants along with the injecting of the hydraulic fracturing fluid, such that the sand or manufactured proppants enter the macro-fractures formed as a result of the injection of the hydraulic fracturing fluid.

8. The method of claim 1 wherein the primary fracture includes sand or manufactured proppants that were injected during the previous hydraulic fracturing operation that caused the formation of the primary fracture.

9. The method of claim 1 wherein the injection of the oxidizer is stopped before the hydraulic fracturing fluid is injected.

10. A method for hydraulically re-fracturing a shale formation section which, prior to being heated from combustion of oxidizer, comprises hydrocarbons with substantially no kerogen or heavy oils having an API gravity of less than 25 degrees, the method comprising:

(a) positioning one or more packers in a horizontal wellbore such that a first wellbore section is substantially isolated from fluid communication with a second wellbore section, a first primary fracture formed by a previous hydraulic fracturing operation is connected to the first wellbore section and contains residual hydrocarbons, and a second primary fracture formed by a previous hydraulic fracturing operation is connected to the second wellbore section and contains residual hydrocarbons, wherein the first and second primary fractures are in a shale formation section that includes a shale matrix that includes pores containing hydrocarbon gas or liquid and having a structure with substantially no kerogen or heavy oils with an API gravity of less than 25 degrees;

(b) injecting oxidizer into the first wellbore section;

(c) reacting oxidizer with residual hydrocarbons in the first primary fracture to form a combustion product and heat, wherein the residual hydrocarbons are hydrocarbons remaining in the first primary fracture after a previous hydraulic fracturing operation;

(d) transferring the heat through the shale matrix to a first primary fracture pore that contains hydrocarbon gas or liquid;

(e) rupturing the first primary fracture pore by heating hydrocarbon gas or liquid contained in the first primary fracture pore and thereby raising the temperature of any hydrocarbon gas in the first primary fracture pore and of any hydrocarbon liquid in the first primary fracture pore sufficiently for the hydrocarbon liquid to form hydrocarbon gas and raising the pressure of hydrocarbon gas being heated in the first primary fracture pore to a level sufficient to rupture the first primary fracture pore, weaken the structure of the shale matrix, and form a first micro-fracture in the shale matrix, which first micro-fracture is either connected to the first primary fracture and contains hydrocarbons that are consumed by combustion or is not connected to the first primary fracture and contains hydrocarbons that are not consumed by combustion, wherein the first primary fracture pore is located within five feet of the first primary fracture and the temperature of the shale matrix surrounding the first primary fracture pore experiences an increase of 100 to 300 degrees Fahrenheit within a period of 1 to 7 days from when the combustion product is formed in the first primary fracture as a result of the reaction of the oxidizer with the residual hydrocarbons;

(f) injecting hydraulic fracturing fluid through the horizontal wellbore and into the first primary fracture to form one or more macro-fractures in the shale matrix having a weakened structure by expanding or coalescing the micro-fractures during the injecting of the hydraulic fracturing fluid;

(g) injecting oxidizer into the second wellbore section;

(h) reacting oxidizer with residual hydrocarbons in the second primary fracture to form a combustion product and heat, wherein the residual hydrocarbons are hydrocarbons remaining in the second primary fracture after a previous hydraulic fracturing operation;

(i) transferring the heat through the shale matrix to a second primary fracture pore that contains hydrocarbon gas or liquid;

(j) rupturing the second primary fracture pore by heating hydrocarbon gas or liquid contained in the second primary fracture pore and thereby raising the temperature of any hydrocarbon gas in the second primary fracture pore and of any hydrocarbon liquid in the second primary fracture pore sufficiently for the hydrocarbon liquid to form hydrocarbon gas and raising the pressure of the hydrocarbon gas being heated in the second primary fracture pore to a level sufficient to rupture the second primary fracture pore, weaken the structure of the shale matrix, and form a second micro-fracture in the shale matrix, wherein the second micro-fracture is either connected to the second primary fracture and contains hydrocarbons that are consumed by combustion or is not connected to the second primary fracture and contains hydrocarbons that are not consumed by combustion;

wherein the second primary fracture pore is located within five feet of the first primary fracture and the temperature of the shale matrix surrounding the second primary fracture pore experiences an increase of 100 to 300 degrees Fahrenheit within a period of 1 to 7 days from when the combustion product is formed in the first primary fracture as a result of the reaction of the oxidizer with the residual hydrocarbon gas; and (k) injecting hydraulic fracturing fluid through the wellbore and into the second primary fracture to form one or more macro-fractures in the shale matrix which has a weakened structure by expanding or coalescing the micro-fractures during the injecting of the hydraulic fracturing fluid, wherein hydraulic fracturing fluid is injected through the wellbore and into the first primary fracture either before or after the oxidizer is injected into the second wellbore section and hydraulic fracturing fluid is injected through the wellbore.

11. The method of claim 10 wherein hydraulic fracturing fluid is injected through the horizontal wellbore and into the first primary fracture before or after the oxidizer is injected into the second horizontal wellbore section and hydraulic fracturing fluid is injected through the horizontal wellbore.

* * * * *